US010369810B2

(12) United States Patent
Yamazaki et al.

(10) Patent No.: US 10,369,810 B2
(45) Date of Patent: Aug. 6, 2019

(54) FEEDING UNIT AND PRINTER

(71) Applicants: CITIZEN WATCH CO., LTD., Tokyo (JP); CITIZEN SYSTEMS JAPAN CO., LTD., Tokyo (JP)

(72) Inventors: Takeshi Yamazaki, Iida (JP); Akira Takahashi, Iida (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 15/742,340

(22) PCT Filed: May 31, 2016

(86) PCT No.: PCT/JP2016/066083

§ 371 (c)(1),
(2) Date: Jan. 5, 2018

(87) PCT Pub. No.: WO2017/006649

PCT Pub. Date: Jan. 12, 2017

(65) Prior Publication Data

US 2018/0201030 A1 Jul. 19, 2018

(30) Foreign Application Priority Data

Jul. 6, 2015 (JP) ..... 2015-135687

(51) Int. Cl.
*B41J 3/60* (2006.01)
*B41J 2/325* (2006.01)
(Continued)

(52) U.S. Cl.
CPC ..... *B41J 3/60* (2013.01); *B41J 2/325* (2013.01); *B41J 3/54* (2013.01); *B41J 11/70* (2013.01);
(Continued)

(58) Field of Classification Search
CPC ... B41J 3/60; B41J 3/543; B41J 11/663; B41J 11/70; B41J 11/706; B41J 15/00
See application file for complete search history.

(56) References Cited

U.S. PATENT DOCUMENTS 4,191,369 A * 3/1980 Matsuda ..... G03D 13/003 271/186
5,478,161 A 12/1995 Suzuki et al.
(Continued)

FOREIGN PATENT DOCUMENTS

CN 1114263 A 1/1996
CN 1392457 A 1/2003
(Continued)

OTHER PUBLICATIONS

International Search Report (English and Japanese) and Written Opinion (Japanese), dated Aug. 2, 2016, for corresponding international application PCT/JP2016/066083.
(Continued)

*Primary Examiner* — John Zimmermann
(74) *Attorney, Agent, or Firm* — Myers Wolin, LLC

(57) ABSTRACT

A first feeding unit is configured that is provided in a first printing unit that includes a first recording unit that executes a recording operation for a long strip-like recording medium pulled out from a first holding unit that holds the recording medium in a wound state. The first feeding unit further includes a pair of feeding rollers that sort the recording medium discharged from the first printing unit, to the side of a second printing unit stacked on the first printing unit or to the side opposite to that of the second printing unit. The first feeding unit temporarily accommodates the sorted recording medium and thereafter, feeds the recording medium to a
(Continued)

guide path, and sorts the recording medium fed by the pair of feeding rollers, to the side of the second printing unit using a sorting part.

11 Claims, 15 Drawing Sheets

(51) Int. Cl.

| | |
|---|---|
| ***B41J 3/54*** | (2006.01) |
| ***B41J 15/04*** | (2006.01) |
| ***B41J 29/00*** | (2006.01) |
| ***B65H 29/60*** | (2006.01) |
| ***B41J 15/18*** | (2006.01) |
| ***B41J 11/70*** | (2006.01) |
| ***B41J 13/00*** | (2006.01) |
| ***B65H 35/00*** | (2006.01) |

(52) U.S. Cl.
CPC ..... *B41J 13/0045* (2013.01); *B41J 15/04* (2013.01); *B41J 15/18* (2013.01); *B41J 29/00* (2013.01); *B65H 29/60* (2013.01); *B65H 35/006* (2013.01); *B65H 2301/132* (2013.01); *B65H 2301/33312* (2013.01); *B65H 2404/632* (2013.01); *B65H 2801/12* (2013.01)

(56) References Cited

U.S. PATENT DOCUMENTS

| | | | | |
|---|---|---|---|---|
| 5,548,390 | A * | 8/1996 | Sugisaki | B41J 15/00 399/364 |
| 5,896,187 | A * | 4/1999 | Matsumoto | G03B 27/44 355/29 |
| 6,172,736 | B1 * | 1/2001 | Yamamoto | G03B 27/32 355/28 |
| 6,382,850 | B1 * | 5/2002 | Freund | B41J 3/60 347/102 |
| 6,390,464 | B1 * | 5/2002 | Gutierrez | B65H 15/00 271/176 |
| 6,916,132 | B2 * | 7/2005 | Otsuka | B41J 3/60 400/188 |
| 9,079,426 | B2 * | 7/2015 | Helterline | B41J 3/60 |
| 2002/0191978 | A1 | 12/2002 | Morimoto | |
| 2005/0046679 | A1 * | 3/2005 | Sanada | B41J 2/14201 347/68 |
| 2011/0279508 | A1 * | 11/2011 | Naito | B41J 2/16526 347/16 |
| 2014/0037354 | A1 | 2/2014 | Araki | |
| 2014/0071194 | A1 | 3/2014 | Inokuchi et al. | |

FOREIGN PATENT DOCUMENTS

| | | | |
|---|---|---|---|
| CN | 103660614 | A | 9/2016 |
| JP | 2003305893 | A | 10/2003 |
| JP | 2005028598 | A | 2/2005 |
| JP | 2011093255 | A | 5/2011 |
| JP | 2011093256 | A | 5/2011 |
| JP | 2011230386 | A | 11/2011 |
| JP | 2014028474 | A | 2/2014 |
| JP | 2014055042 | A | 3/2014 |

OTHER PUBLICATIONS

First Office Action issued by the China National Intellectual Property Administration for corresponding Chinese Patent Application No. 201680039773.8, dated Dec. 19, 2018, with a partial English translation.

Extended European search report with supplementary European search report and the European search opinion with Annex issued by the European Patent Office for corresponding European Patent Application No. 16821120.9, dated Feb. 14, 2019.

* cited by examiner

FEEDING UNIT AND PRINTER

TECHNICAL FIELD

The present invention relates to a printer capable of recording on both sides of a recording medium and a feeding unit used in this printer.

BACKGROUND ART

A conventional printer executes a recording operation with respect to a recording medium that is to be subject to the recording operation, based on a recording instruction received from an external apparatus. Such printers include a printer that executes a recording operation not only for one side of the recording medium but also for both sides of the recording medium. Among such printers is a printer that uses the recording medium after cutting the recording medium in a wound state into pieces each having a predetermined length.

For example, according to a conventional technique for a thermal printer that executes a recording operation for a recording medium, the thermal printer includes an inverting mechanism that rotates a holding unit that holds a recording medium in a wound state or a thermal head unit that executes the recording operation with respect to the recording medium and the recording operation is adapted to be executed for both sides of the recording medium by inverting the front side and the back side of the recording medium facing the thermal head unit using the inverting mechanism (see, e.g., Patent Document 1 below).

For example, according to a conventional technique for a thermal printer that includes plural thermal head units (such as a thermal head unit executing an ordinary recording operation using ordinary consumables such as an ink ribbon, and a thermal head unit executing a special recording operation to provide a protective layer protecting the surface of the recording medium, to execute processing to provide a gold/silver/colored foil (foil stamping), or the like), the thermal printer includes an inverting mechanism that rotates a holding unit that holds a recording medium in a wound state or a thermal head unit executing the recording operation for the recording medium and the recording operation is executed with respect to both sides of the recording medium by inverting the front side and the back side facing the thermal head unit of the recording medium using the inverting mechanism (see, e.g., Patent Document 2 below).

For example, according to a conventional technique for a printer that includes a printer unit that executes a recording operation for a recording medium and an inverting unit, a cut paper sheet-like recording medium is held in the inverting unit and the printer unit executes a recording operation for a long strip-like recording medium and also executes another recording operation for the cut paper sheet-like recording medium (see, e.g., Patent Document 3 below).

Patent Document 1: Japanese Laid-Open Patent Publication No. 2011-93255

Patent Document 2: Japanese Laid-Open Patent Publication No. 2011-93256

Patent Document 3: Japanese Laid-Open Patent Publication No. 2014-55042

DISCLOSURE OF INVENTION

Problem to be Solved by the Invention

However, with the conventional techniques described in Patent Documents 1 and 2, the mechanism used inverts the recording medium in a wound state together with the holding unit that holds the recording medium and therefore, a problem arises in that the size of the apparatus is increased. With the conventional techniques described in Patent Documents 1 and 2, space needs to be secured for moving the members interlocked with the inversion of the holding unit between the holding unit and the thermal head unit and therefore, a problem arises in that the size of the apparatus increases.

Further, with the conventional techniques described in Patent Documents 1 to 3, when the recording operation is executed for both sides of the recording medium, the sides (surfaces) of the recording medium for which a recording operation has been executed with respect to the front side are inverted by the inverting unit and another recording operation is executed for the back side of the recording medium using the same recording unit that executed the recording operation for the front side. Therefore, a problem arises in that a long period of time is necessary until the completion of the recording operations for both sides of the recording medium.

With the conventional techniques described in Patent Documents 1 to 3, the recording operations are executed for both sides of the recording medium and structures specialized for the two-side recording such as the inverting unit are necessary. Thus, a problem arises in that a high cost is necessary for development, design, and manufacturing. With the technique described in Patent Document 1, the recording unit that executes the recording operation and the inverting unit that inverts the sides of the recording medium are controlled interlocking these units with each other and control dedicated therefor needs to be executed, whereby a problem arises in that a high cost is necessary for development and design.

With the conventional techniques described in Patent Documents 1 to 3, the inverting unit is provided under the recording unit that executes the recording operation, and a problem arises in that when the recording medium clogs the feeding path, that is, when so-called jamming occurs, work for recovery such as removal of the recording medium causing the jamming becomes complicated.

To solve the above problems associated with the conventional techniques, an object of the present invention is to provide a printer that has a high degree of freedom and is capable of executing a recording operation in accordance with the use by each user without a high cost for development, design, and manufacturing, and to provide a feeding unit used in the printer.

Means for Solving Problem

To solve the problems above and achieve an object, a feeding unit according to the present invention is provided in a printer that includes a holding unit that holds a long strip-like recording medium in a wound state and a recording unit that executes a recording operation with respect to the recording medium pulled out from the holding unit, the printer cutting off and discharging the long strip-like recording medium on which the recording operation has been executed, the feeding unit includes a sorting part that sorts the recording medium discharged from the printer, to a side of a second printer stacked on the printer and having a configuration identical to a configuration of the printer, or to a position different from the side of the other printer; a guiding part that guides the recording medium sorted by the sorting part to the side of the second printer, to be supplied to a position to which a second recording medium held by the second printer is pulled out, the guiding part guiding the recording medium along a direction identical to a direction to pull out the second recording medium; and a feeding part that accommodates the recording medium sorted to the position different from the side of the second printer by the sorting part, the feeding part accommodating the recording medium until a tail end of the recording medium passes through the sorting part, the feeding part feeding the recording medium to the guiding part starting with the tail end, when the tail end passes through the sorting part. The sorting part sorts the recording medium fed by the feeding part, to the side of the second printer.

Further, in feeding unit, the sorting part is a flap-like member provided near a discharge position where the recording medium is discharged from the printer, the sorting part is arbitrarily switched between a first position to communicate the discharge position and the guiding part with each other and a second position to communicate the feeding part and the guiding part with each other.

In the feeding unit, the feeding part includes a space that is provided at a position different from the side of the second printer in the printer and that accommodates the recording medium sorted to the position different from the side of the second printer, without folding the recording medium.

In the feeding unit, the feeding part includes a pair of rollers that feed the recording medium sorted to the position different from the side of the second printer, to an inside of the space, the feeding part accommodates the recording medium in the space by rotating the pair of rollers in a first rotation direction, and feeds the recording medium to the guiding part starting with the tail end of the recording medium by rotating the pair of rollers in a second rotation direction that is reverse to the first rotation direction.

In the feeding unit, the space is provided on a side of the printer, opposite a side of the printer having a position at which the printer and the second printer are stacked on each other.

In the feeding unit, the sorting part sorts the recording medium discharged from the printer, to an upper side or a lower side in a vertical direction and feeds the recording medium fed to the feeding part, to the guiding part along the vertical direction.

In the feeding unit, the space is provided between the printer and the second printer.

In the feeding unit, the sorting part feeds the recording medium discharged from the printer, by sorting the recording medium to the upper side in the vertical direction, feeds the recording medium to the space by sorting the recording medium in a direction intersecting the vertical direction, and further feeds the recording medium fed to the space to the guiding part along the vertical direction.

The feeding unit further includes a housing that accommodates the sorting part, the guiding part, and the feeding part. The housing includes a discharging unit that discharges to an exterior of the housing, the recording medium discharged from the second printer.

A printer according to the present invention includes a printing unit that includes: a holding unit that holds a long strip-like recording medium in a wound state, a recording unit that executes a recording operation for the recording medium pulled out from the holding unit, and a cutter unit that cuts the long strip-like recording medium for which a recording operation is executed by the recording unit; the printer further including a sorting part that sorts the recording medium cut off by the cutter unit, to a side of a second printing unit stacked on the printing unit and having an identical configuration as that of the printing unit, or to a position different from the side of the second printing unit; a guiding part that guides the recording medium sorted by the sorting part to the side of the second printing unit, to be supplied to a position to which a second recording medium held by the second printing unit is pulled out, the guiding part guiding the recording medium along a direction identical to a direction to pull out the second recording medium; and a feeding part that accommodates the recording medium sorted to the position different from the side of the second printing unit by the sorting part, the feeding part accommodating the recording medium until a tail end of the recording medium passes through the sorting part, the feeding part feeding the recording medium to the guiding part starting with the tail end, when the tail end passes through the sorting part. The sorting part sorts the recording medium fed by the feeding part, to the side of the second printing unit.

Effect of the Invention

According to the feeding unit and the printer of the present invention, an effect is achieved in that a recording operation in accordance with the use by each user can be executed without a high cost for the development, the design, and the manufacture thereof, and improvement of the degree of freedom can be facilitated.

BEST MODE(S) FOR CARRYING OUT THE INVENTION

Embodiments of a feeding unit and a printer according to the present invention will be described in detail with reference to the accompanying drawings.

First Embodiment (Outer Appearance of Printer)

Figure 1:
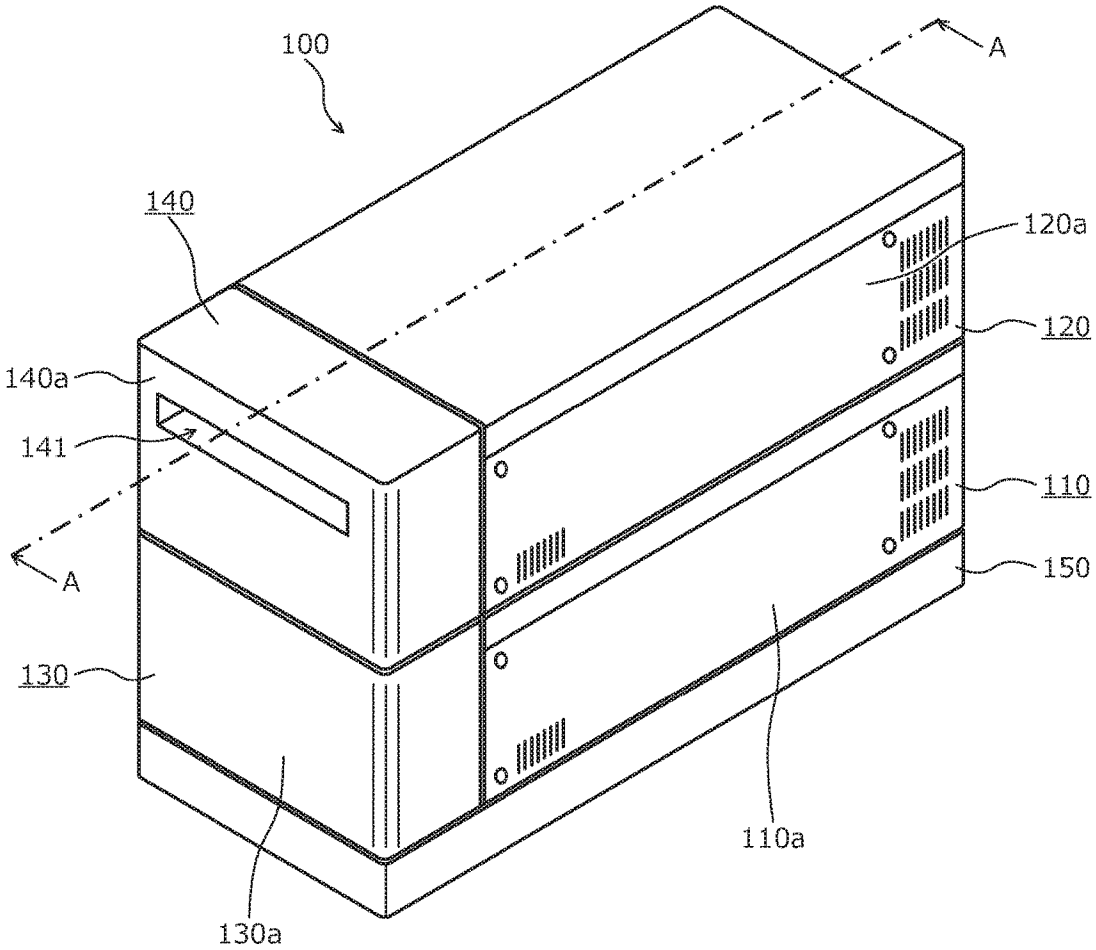
FIG. 1 is an explanatory diagram of an outer appearance of a printer of a first embodiment according to the present invention.

An outer appearance of a printer of the first embodiment according to the present invention will first be described. FIG. 1 is an explanatory diagram of the outer appearance of the printer of the first embodiment according to the present invention. In FIG. 1, the printer 100 of the first embodiment according to the present invention includes two printing units 110 and 120, and feeding units 130 and 140 provided on the front sides of the print units 110 and 120. The feeding units 130 and 140 are provided on the front sides (the side on which operations by a user are received) of the printing units 110 and 120.

The two printing units 110 and 120 respectively include housings 110*a* and 120*a* that each have a substantially box-like shape and that have substantially identical shapes. The printer 100 is used in a state where the housings 110*a* and 120*a* are stacked on each other in a vertical direction. The printing unit 110 (hereinafter, referred to as "first printing unit") on the lower side in the vertical direction and the printing unit 120 (hereinafter, referred to as "second printing unit") on the upper side in the vertical direction have similar outer appearances. The first printing unit 110 and the second printing unit 120 are separable from each other.

The first printing unit 110 and the second printing unit 120 can each independently execute a recording operation. As to the first printing unit 110 and the second printing unit 120, the first printing unit 110 alone or the second printing unit 120 alone can be used as an independent printer.

The first printing unit 110 and the feeding unit 130 (hereinafter, referred to as "first feeding unit") corresponding to the first printing unit 110 are separable from each other. The second printing unit 120 and the feeding unit 140 (hereinafter, referred to as "second feeding unit") corresponding to the second printing unit 120 are separable from each other. The first feeding unit 130 and the second feeding unit 140 are separable from each other.

Each of connection portions of the first printing unit 110 and the second printing unit 120, and each of connection portions of the printing units 110 and 120, and the feeding units 130 and 140 may have a shape (not depicted) to position the connection counterpart. Even when the printing units 110 and 120 are configured to be separable from each other, the positional relation between the printing units 110 and 120 and the positional relations between the printing units 110 and 120, and the feeding units 130 and 140 can thereby be precisely and easily established.

A discharging exit 141 that discharges the recording medium that passes through the second printing unit 120 is provided on the housing 140*a* of the second feeding unit 140. The printer 100 discharges a recorded matter for which recording is executed by the second printing unit 120, to the exterior of the printer 100 through the discharging exit 141. The housing 130*a* of the first feeding unit 130 has no opening especially provided thereon and has a substantially box-like shape that is flush with the housing 110*a* of the first printing unit 110.

In the printer 100, a tray 150 having a hollow box-like shape is provided on the lower side of the first printing unit 110 and the first feeding unit 130. A predetermined space can be secured on the lower side of the first printing unit 110 and the first feeding unit 130 by providing the tray 150. The tray 150 is open at least at a position facing the first feeding unit 130 and includes a space that can accommodate the recording medium that protrudes from the first feeding unit 130 downward in the vertical direction to be lower than the first feeding unit 130. In the first embodiment, the space included in the tray 150 can realize a "space that accommodates the recording medium without folding the recording medium" according to the present invention.

In the first embodiment, the first printing unit 110 realizes a printer according to the present invention and the second printing unit 120 realizes another printer according to the present invention. In the first embodiment, the first feeding unit 130 and the second feeding unit 140 each realize a feeding unit according to the present invention.

(Internal Configuration of Printer 100)

Figure 2:
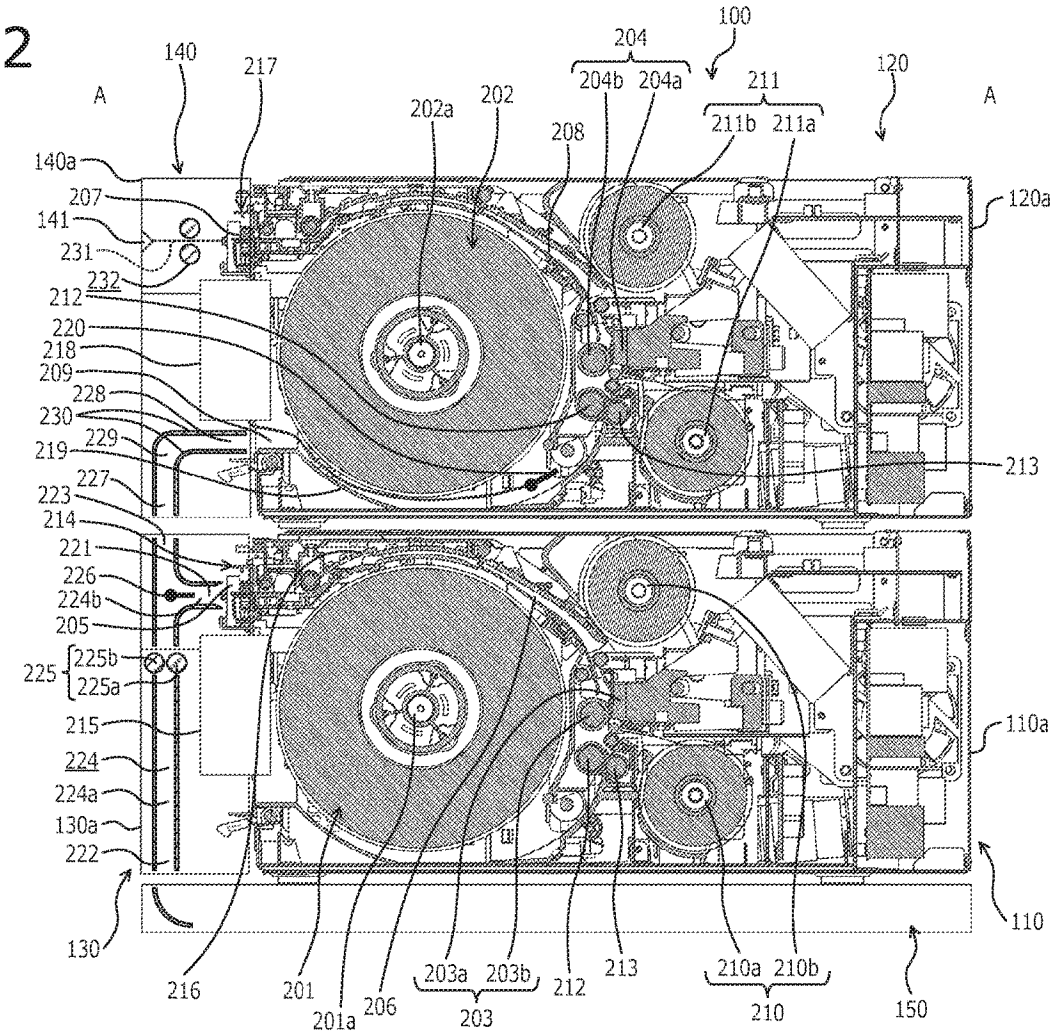
FIG. 2 is a cross-sectional view along A-A of FIG. 1.

An internal configuration of the printer 100 of the first embodiment according to the present invention will be described. FIG. 2 is a cross-sectional view along A-A of FIG. 1. In FIG. 2, the first printing unit 110 and the second printing unit 120 respectively have holding units 201 and 202 that each hold a recording medium that is to be recorded on. The first holding unit 201 and the second holding unit 202 have a same configuration. In the first embodiment, the first holding unit 201 realizes a holding unit according to the present invention.

The first holding unit 201 and the second holding unit 202 include holding shafts 201*a* and 202*a* that are provided enabling rotation around an axis with the front side-back side direction of the paper sheet of FIG. 2 as an axial direction. The first holding unit 201 and the second holding unit 202 each hold, respectively using the holding shafts 201*a* and 202*a*, a winding core to be the winding center of the recording medium having a long strip-like shape and a length aspect wound in a roll. The first holding unit 201 and the second holding unit 202 each thereby hold the wound long strip-like recording medium in a state where the recording medium can be fed out starting with an end on the outer circumference side. In the first embodiment, the recording medium held by the second holding unit 202 realizes another recording medium according to the present invention.

The recording medium includes a recording layer. The recording layer included in the recording medium is provided on the surface of a base material formed by paper or the like. The recording layer includes a heat insulating layer applied or bonded to the base material, and a receiving layer stacked on the heat insulating layer. The first holding unit holds, for example, the recording medium whose base material has a recording layer provided on both sides of the base material. The second holding unit holds, for example, a recording medium whose base material has a recording layer provided only on one side of the base material.

The first printing unit 110 and the second printing unit 120 respectively include recording units 203 and 204 that each executes a recording operation for the recording medium that is to be recorded on (a printing paper sheet). The recording unit (hereinafter, referred to as "first recording unit") 203 included in the first printing unit 110 and the recording unit (hereinafter, referred to as "second recording unit") 204 included in the second printing unit 120 have a same configuration and respectively include thermal heads 203*a* and 204*a*, and platens 203*b* and 204*b*. In the first embodiment, the first recording unit 203 realizes a recording unit according to the present invention.

The first printing unit 110 includes, in the housing 110*a*, a first feeding path 206 from the first holding unit 201 to a first discharging exit 205, through the first recording unit 203. A pair of feeding rollers (not depicted) that feed the recording medium in the first feeding path 206 is provided on the first feeding path 206. The pair of feeding rollers includes rollers forming a pair and arranged facing each other across the first feeding path 206. One or more pairs of feeding rollers are provided on the first feeding path 206.

The thermal head (hereinafter, referred to as "first thermal head") 203*a* and the platen (hereinafter, referred to as "first platen") 203*b* in the first recording unit 203 are arranged facing each other across the first feeding path 206. In the first recording unit 203, the first thermal head 203*a* is provided to be movable between a position to be in contact with the first platen 203*b* and a position to be separated from the first platen 203*b*.

The first platen 203*b* has a cylinder-like shape whose axial direction is the width direction of the recording medium, and is provided enabling rotation around an axis. The first platen 203*b* is provided to be rotatable counterclockwise (the forward direction) on the paper sheet surface of FIG. 2 and clockwise (the reverse direction) on the paper sheet surface of FIG. 2.

A motor not depicted is coupled with the first platen 203*b* through a predetermined gear train. The first platen 203*b* receives a pressure applied to the recording medium by the first thermal head 203*a* facing the first platen 203*b* across the recording medium, passively rotating with the movement of the recording medium in contact therewith due to transmission of the driving force of the motor coupled therewith through the predetermined gear train.

The second printing unit 120 includes, in the housing 120*a*, a second feeding path 208 from the second holding unit 202 to a second discharging exit 207, through the second recording unit 204. The second feeding path 208 extends on the side opposite to that of the second recording unit 204 sandwiching the second holding unit 202 therebetween, and communicates with an insertion entrance 209 provided on the housing 120*a* of the second printing unit 120. The second feeding path 208 therefore communicates from the insertion entrance 209 to the second discharging exit 207, passing through the second holding unit 202 and the second recording unit 204.

The thermal head (hereinafter, referred to as "second thermal head") 204*a* and the platen (hereinafter, referred to as "second platen") 204*b* in the second recording unit 204 are arranged facing each other across the second feeding path 208. In the second recording unit 204, the second thermal head 204*a* is provided to be movable between a position to be in contact with the second platen 204*b* and a position to be separated from the second platen 204*b*.

Similarly to the first platen 203*b*, the second platen 204*b* has a cylinder-like shape whose axial direction is the width direction of the recording medium and is provided enabling rotation around an axis. Similarly to the first platen 203*b*, the second platen 204*b* is provided to be rotatable counterclockwise (the forward direction) on the paper sheet surface of FIG. 2 and clockwise (the reverse direction) on the paper sheet surface of FIG. 2.

A motor not depicted is coupled with the second platen 204*b* through a predetermined gear train. The second platen 204*b* receives a pressure applied to the recording medium by the second thermal head 204*a* facing the second platen 204*b* across the recording medium, passively rotating with the movement of the recording medium in contact therewith.

Figure 3:
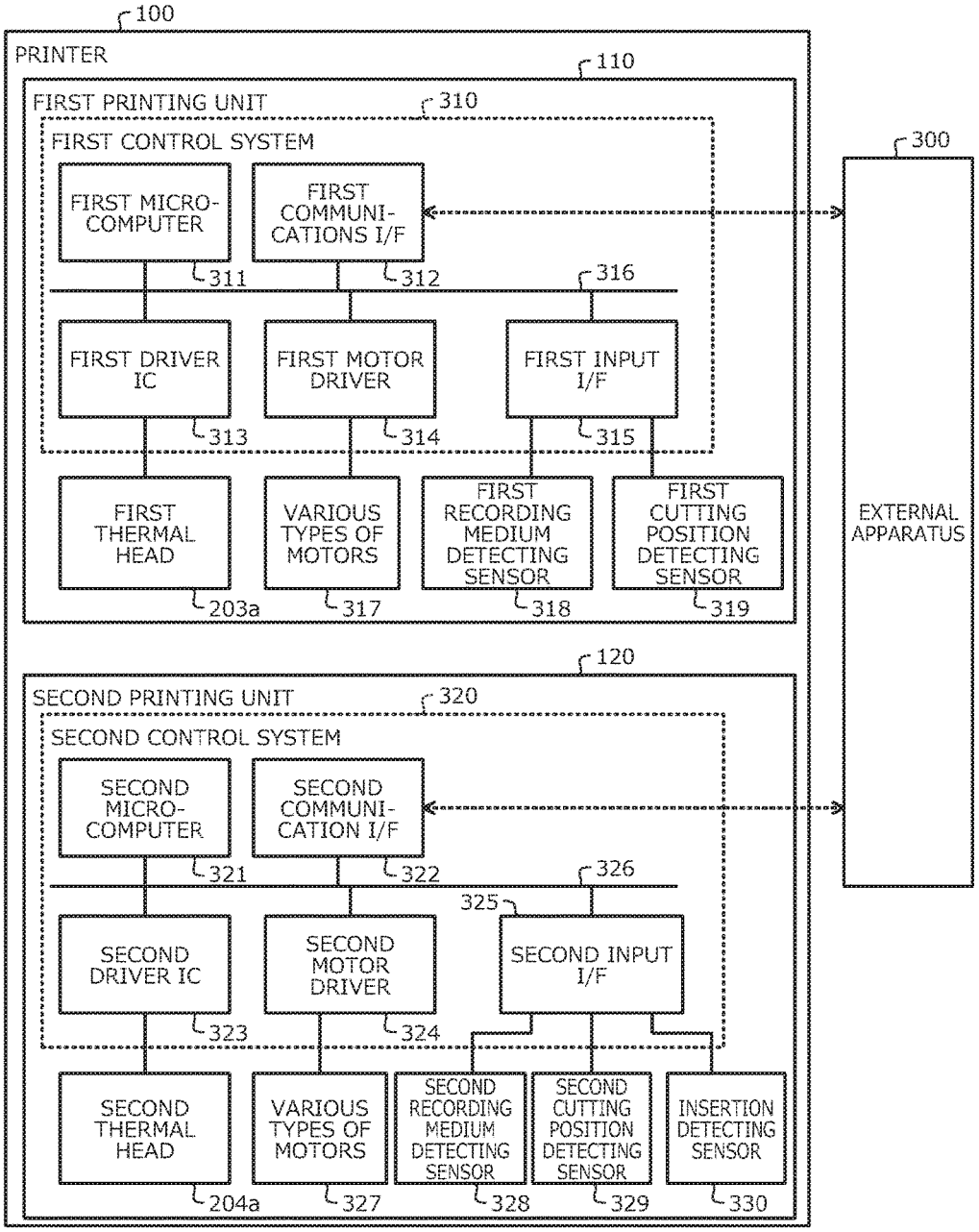
FIG. 3 is an explanatory diagram of a hardware configuration of the printer of the first embodiment according to the present invention.
Figure 4:
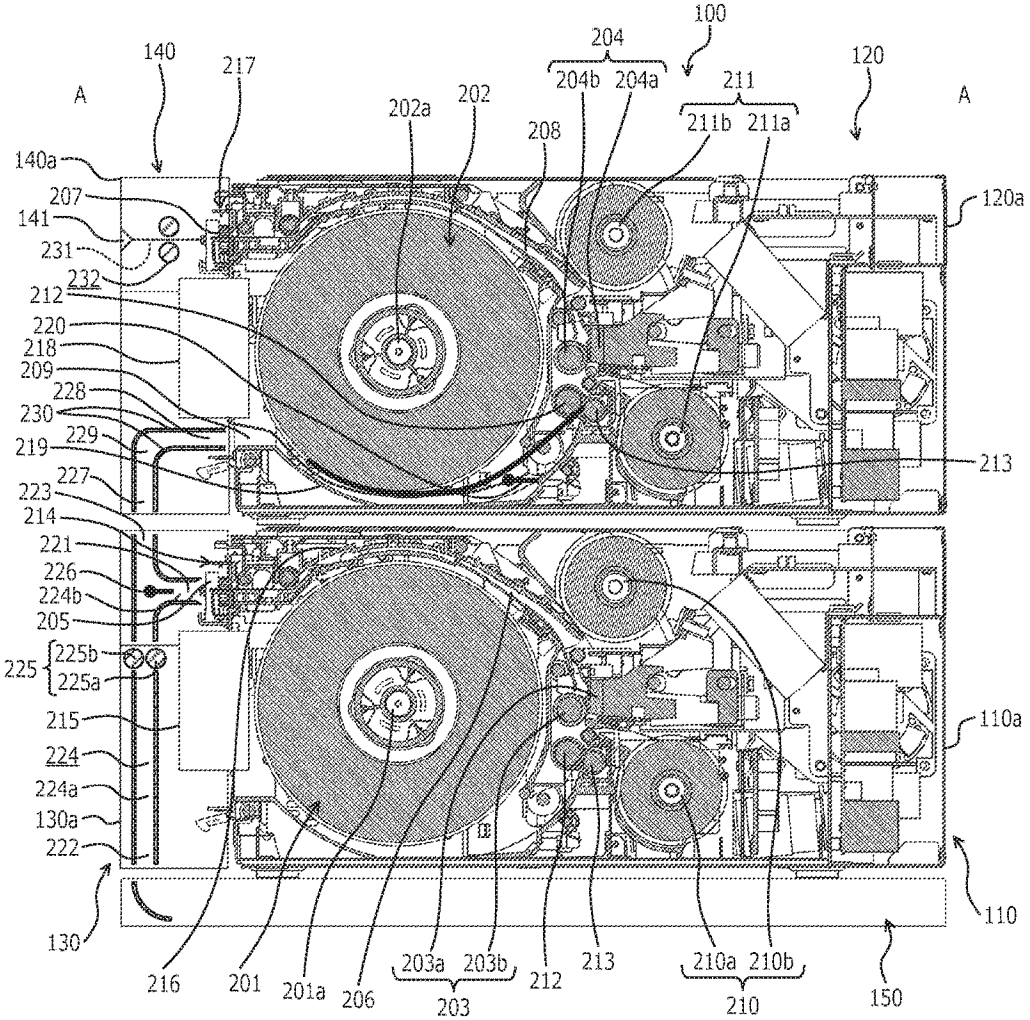
FIG. 4 is an explanatory diagram (part 1) of a recording operation related to one-side recording of the recording operations executed by the printer of the first embodiment according to the present invention.
Figure 5:
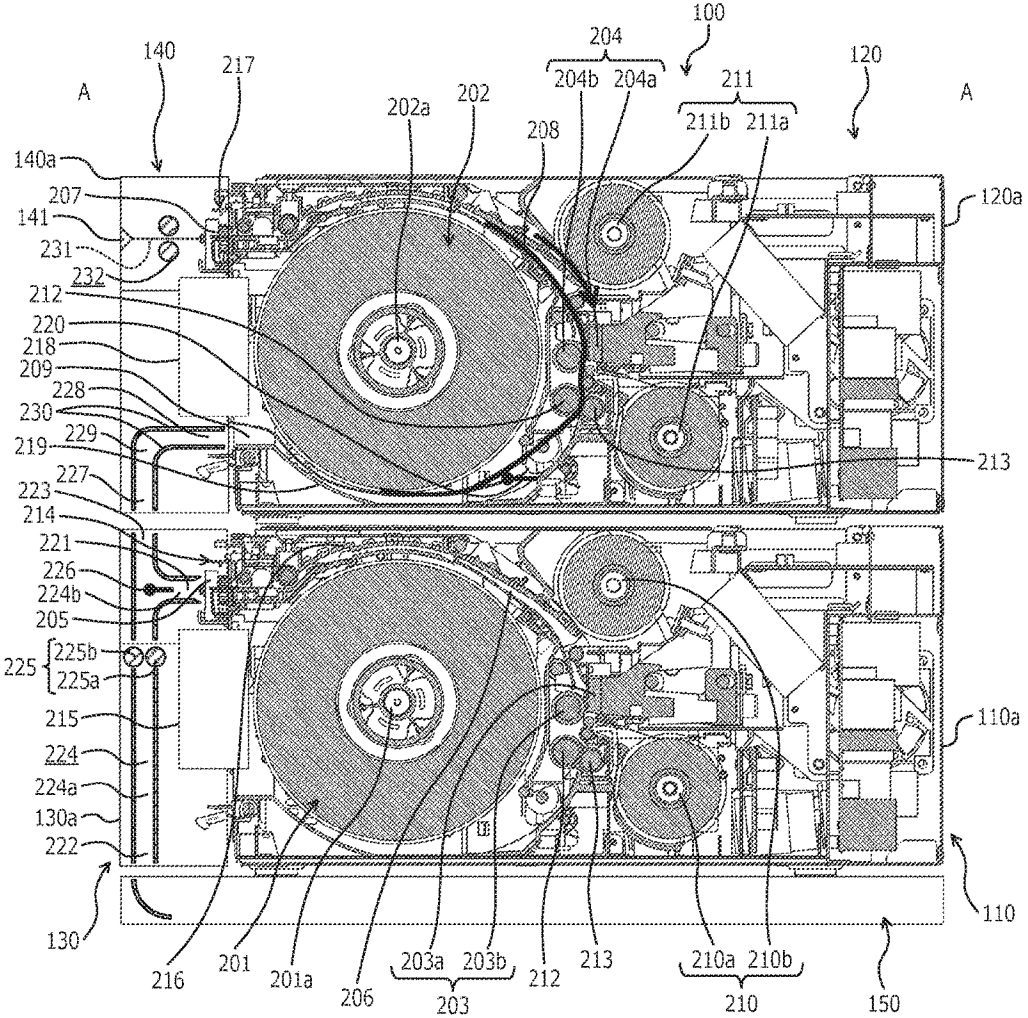
FIG. 5 is an explanatory diagram (part 2) of the recording operation related to the one-side recording of the recording operations executed by the printer of the first embodiment according to the present invention.

Both the first thermal head 203*a* and the second thermal head 204*a* each includes plural heat generating elements (heat generating resistors) that are arranged in a line along the width direction of the recording medium (the front side-back side direction of the paper sheet of FIG. 2) and a driver IC that drives the heat generating elements (see FIG. 3). The driver IC is driven and controlled by a microcomputer (see FIG. 3) included in each of the first printing unit 110 and the second printing unit 120. The driver IC is driven and controlled by a microcomputer and thereby, selectively energizes electrode wires connected to the heat generating elements in each of the first thermal head 203*a* and the second thermal head 204*a*, from a power source not depicted to thereby heat the heat generating elements corresponding to the energized electrode wires.

The microcomputer included in each of the first printing unit 110 and the second printing unit 120 is mounted on a control circuit board provided in each of the first printing unit 110 and the second printing unit 120. The control circuit board drives and controls the components included in each of the first printing unit 110 and the second printing unit 120.

The first printing unit 110 and the second printing unit 120 respectively include ribbon units 210 and 211. The ribbon units 210 and 211 have a same configuration.

For example, the ribbon unit 210 included in the first printing unit 110 includes a pair of rollers 210*a* and 210*b* that hold an ink ribbon. The pair of rollers 210*a* and 210*b* holds the ink ribbon so that the ink ribbon is be stretched between the first thermal head 203*a* and the first platen 203*b*. The pair of rollers 210*a* and 210*b* holds the ink ribbon in a state where an ink layer of the ink ribbon faces the first platen 203*b* between the first thermal head 203*a* and the first platen 203*b*.

The pair of rollers 210*a* and 210*b* in the ribbon unit 210 includes the take-up roller 210*a* and the supply roller 210*b*. The take-up roller 210*a* is provided to be rotatable clockwise in FIG. 2 and accompanying rotation, winds thereon from an end of the ink ribbon, the ink ribbon held by the supply roller 210*b*. The supply roller 210*b* holds the long strip-like ink ribbon wound thereon to enable the long strip-like ink ribbon to be fed out starting with the outer circumference side of the ink ribbon. The supply roller 210*b* rotates clockwise in FIG. 2 associated with the winding up of the ink ribbon accompanying the rotation of the take-up roller 210*a*, and feeds out the ink ribbon starting with the outer circumference side of the ink ribbon.

For example, the ribbon unit 211 included in the second printing unit 120 includes a pair of rollers 211*a* and 211*b* that hold an ink ribbon. The pair of rollers 211*a* and 211*b* holds the ink ribbon so that the ink ribbon is be stretched between the second thermal head 204*a* and the second platen 204*b*.

The pair of rollers 211*a* and 211*b* holds the ink ribbon in a state where an ink layer of the ink ribbon faces the second platen 204*b* between the second thermal head 204*a* and the second platen 204*b*.

The take-up roller 211*a* is provided to be rotatable clockwise in FIG. 2 and accompanying rotation, winds thereon from an end of the ink ribbon, the ink ribbon held by a supply roller 211*b*. The supply roller 211*b* holds the long strip-like ink ribbon wound thereon to enable the long strip-like ink ribbon to be fed out starting from the outer circumference side of the ink ribbon. The supply roller 211*b* rotates clockwise in FIG. 2 associated with the winding up of the ink ribbon by the rotation of the take-up roller 211*a*, and feeds out the ink ribbon starting with the outer circumference side thereof.

The ink ribbons held by the ribbon units 210 and 211 each includes a long strip-like base material and the ink layer provided on one side of the base material. The ink layer is formed by a sublimable dye ink (an ink including a sublimable dye (a sublimable coloring matter, a heat diffusible coloring matter), that is, a sublimable ink). For example, the ink ribbon includes ink layers for colors of yellow (Y), magenta (M), and cyan (C). Each of the ink layers is formed by a sublimable dye ink (an ink including a sublimable dye (a sublimable coloring matter), that is, a sublimable ink).

In the ink ribbon, the ink layers for the plural colors are cyclically arranged along the length direction of the base material for each color. For example, the ink layers for yellow (Y), magenta (M), and cyan (C) are cyclically arranged in order of "the ink layer for yellow (Y) to the ink layer for magenta (M) to the ink layer for cyan (C) to . . . " along the length direction of the base material.

The ink ribbon also includes an overcoat layer. The overcoat layer is cyclically arranged along the length direction of the base material together with the ink layers. For example, in the ink ribbon, the ink layers are cyclically arranged in order of "the ink layer for yellow (Y) to the ink layer for magenta (M) to the ink layer for cyan (C) to the overcoat layer to the ink layer for yellow (Y) . . . " along the length direction of the base material.

The first printing unit 110 and the second printing unit 120 each executes a recording operation employing a sublimation transfer method. The recording operation employing the sublimation transfer method is executed by selectively energizing the heat generating elements in the thermal heads 203*a* and 204*a* to thereby selectively heat the heat generating elements, transmitting the heat generated by the heat generating elements to the ink ribbon, and transferring by sublimation the sublimable dye ink included in the ink layers included in the ink ribbon to the recording medium for the recording layer in the recording medium that is to be recorded on. The receiving layer in the recording medium receives the transfer of the sublimable dye ink included in the ink layer included in the ink ribbon. The printer 100 that executes the recording operation that employs the sublimation transfer method is called, for example, a dye-sublimation printer, or the like.

The dye-sublimation printer can adjust the density of the ink to be transferred to the recording medium for each dot to be recorded. The dye-sublimation printer is therefore excellent in dark tone representation. Because the dye-sublimation printer can present excellent dark tone representation, image quality sufficient for the use of printing photographs can be acquired with the dye-sublimation printer. Therefore, the dye-sublimation printer is also recently employed for use in desktop publishing (DTP).

In the recording operation, each of the first printing unit 110 and the second printing unit 120 performs a lamination process with respect to the surface of the recording medium (a recording face) on which the recording operation is executed, by providing the overcoat layer to cover the recording face. This enables degradation of the water-resistance performance and the weather-resistant performance of the sublimable dye ink in the recorded matter to be suppressed, enhancing the water resistance and the weather resistance of the recorded matter. When the recording operations are executed for both sides of the recording medium, the overcoat layer is provided for each recording operation for each of the sides.

The first printing unit 110 and the second printing unit 120 each includes a grip roller 212 and a pinch roller 213. The grip roller 212 and the pinch roller 213 are arranged facing each other across the first feeding path 206 and the second feeding path 208.

Each of the grip rollers 212 is provided on the side facing toward the back side of the recording medium in the recording operations by the first recording unit 203 and the second recording unit 204. Each of the pinch rollers 213 is urged in a direction for the pinch roller 213 to abut the grip roller 212 arranged facing the pinch roller 213. The grip roller 212 and the pinch roller 213 can thereby hold and pinch the recording medium that is fed in the first feeding path 206 and the second feeding path 208.

The grip roller 212 includes a protrusion (not depicted) that protrudes toward the outer circumference. Slippage can thereby be prevented between the grip roller 212 and the recording medium. The force for the grip roller 212 and the pinch roller 213 to be able to hold, pinch, and feed the recording medium (a grip force) is secured to sufficiently be larger than the load applied to the recording medium by the first recording unit 203, the second recording unit 204, the first feeding path 206, and the second feeding path 208. Thus, slippage can thereby be reliably prevented between the grip roller 212 and the recording medium.

The grip roller 212 is coupled with a motor (see FIG. 3) through a predetermined gear train, whereby the grip roller 212 can be rotated in a state where the recording medium is held and pinched between the grip roller 212 and the pinch roller 213. The rotation of the grip roller 212 in the state where the recording medium is held and pinched between the grip roller 212 and the pinch roller 213 enables control of the position of the recording medium relative to the recording positions of the first thermal head 203*a* and the first platen 203*b* and of the second thermal head 204*a* and the second platen 204*b*.

In the first printing unit 110, a first recording medium detecting sensor (see reference numeral "318" in FIG. 3) that detects the position of the lead end of the recording medium pulled out from the first holding unit 201 to the first feeding path 206 is provided near the grip roller 212. The first recording medium detecting sensor includes, for example, a light emitting element and a light receiving element that are arranged facing each other across the first feeding path 206, and can be realized by an optical sensor that varies according to variations in the amount of light received at the light receiving element.

The amount of light received at the light receiving element varies due to the passage of the recording medium fed in the first feeding path 206, between the light emitting element and the light receiving element, and the first printing unit 110 can detect the position of the lead end of the recording medium pulled out from the first holding unit 201 to the first feeding path 206 based on the output value of the first recording medium detecting sensor, the output value varying according to variations in of the amount of light received.

In the second printing unit 120, similarly to the first printing unit 110, a second recording medium detecting sensor (see reference numeral "328" in FIG. 3) that detects the position of the lead end of the recording medium pulled out from the second holding unit 202 to the second feeding path 208 is provided near the grip roller 212. Similarly to the first recording medium detecting sensor, the second recording medium detecting sensor can be realized by an optical sensor that includes a light emitting element and a light receiving element that are arranged facing each other across the second feeding path 208.

The recording positions for the colors relative to the recording medium can be aligned precisely for the recording operations by the first recording unit 203 and the second recording unit 204 and high quality recorded results can be obtained by providing the first recording medium detecting sensor and the second recording medium detecting sensor each near the grip roller 212.

In the first printing unit 110, a first cutter mechanism 214 is provided near the first discharging exit 205. The first cutter mechanism 214 includes a fixed blade whose position is fixed and a movable blade provided to be movable in the width direction of the recording medium along the fixed blade (reciprocal movement) (blades not depicted). The movable blade is in contact with the fixed blade and is provided at a position to divide the first feeding path 206. The movable blade has a circular plate-like shape including a blade in its outer circumferential portion, and is provided to be movable in the width direction of the recording medium along the fixed blade (reciprocal movement). The movable blade is positioned at a position so as not to interfere with the passage of the recording medium, during a non-operation such as a case where the movable blade stands by until cutting of the recording medium.

The first cutter mechanism 214 includes a driving source such as a motor for driving the movable blade, a power transmission mechanism that transmits a driving force generated by the motor for driving the movable blade to the movable blade (neither are depicted), and the like. The first cutter mechanism 214 cuts the recording medium by moving the movable blade in the width direction of the recording medium by using the driving force generated by the motor for driving the movable blade in a state where the cutting position of the recording medium (that is, the position to be cut at) is fed up to the position at which the movable blade in the first feeding path 206 moves to transversely run in the first feeding path 206 (reciprocal movement) (that is, the position at which the first cutter mechanism 214 is to cut).

In the first printing unit 110, a first cutting position detecting sensor (see reference numeral "319" in FIG. 3) whose output value varies according to the presence or absence of the recording medium is provided near the cutting position for the first cutting mechanism 214. Similarly to the first recording medium detecting sensor, the first cutting position detecting sensor includes, for example, a light emitting element and a light receiving element that are arranged facing each other across the first feeding path 206, and can be realized by an optical sensor that varies according to variations in the amount of light received at the light receiving element.

In the first printing unit 110, a first cutting waste accommodating unit 215 that accommodates cutting waste (cut paper waste) produced when the recording medium is cut by the first cutter mechanism 214 is provided on the lower side in the vertical direction of the first cutter mechanism 214. The first cutting waste accommodating unit 215 includes an opening (not depicted) that opens on the side toward the first cutter mechanism 214, the first cutting waste accommodating unit 215 is provided on the housing 110*a* of the first printing unit 110 to be attached thereto and detached therefrom.

The first printing unit 110 includes a first guide member 216 that guides the position of the recording medium to be recorded on so that the recording medium is fed in the first feeding path 206 in the housing 110*a*. The first guide member 216 guides the position of the recording medium so that the recording medium pulled out from the first holding unit 201 is fed to the first cutter mechanism 214 through the first recording unit 203.

In the second printing unit 120, a second cutter mechanism 217 is provided near the second discharging exit 207. The second cutter mechanism 217 has a same configuration as that of the first cutter mechanism 214 and includes a fixed blade, a movable blade, a driving source, a power transmission mechanism, and the like. In the second printing unit 120, a second cutting position detecting sensor (see reference numeral "329" in FIG. 3) whose output value varies according to the presence or absence of the recording medium is provided near the cutting position of the second cutting mechanism 217. For example, similarly to the first recording medium detecting sensor and the first cutting position detecting sensor, the second cutting position detecting sensor includes a light emitting element and a light receiving element that are arranged facing each other across the second feeding path 208, and can be realized by an optical sensor that varies according to variations the amount of light received at the light receiving element.

In the second printing unit 120, a second cutting waste accommodating unit 218 is provided on the lower side in the vertical direction of the second cutter mechanism 217. The second cutting waste accommodating unit 218 has a same configuration as that of the first cutting waste accommodating unit 215, includes an opening (not depicted) that opens on the side toward the second cutter mechanism 217, and is provided on the housing 120*a* of the second printing unit 120 to be attached thereto and detached therefrom.

The second printing unit 120 includes a second guide member 219 that guides the position of the recording medium that is to be recorded on so that the recording medium is fed in the second feeding path 208 in the housing 120*a*. The second guide member 219 guides the position of the recording medium so that the recording medium pulled out from the second holding unit 202 is fed to the second cutter mechanism 217 through the second recording unit 204.

The second printing unit 120 includes the guide member 219 that guides the position of the recording medium fed from the side of the first printing unit 110 through the insertion entrance 209 so that the recording medium is fed to the second recording unit 204. In the guide member 219, a switching member 220 is provided on an end thereof toward the second recording unit 204.

The switching member 220 is selectively positioned at a position for a continuous paper sheet and a position for a cut paper sheet depending on the type of the recording medium supplied to the second recording unit 204. The switching member 220 is positioned at the position for a continuous paper sheet when the recording operation is executed with respect a recording medium held by the second holding unit 202, and closes the path leading from the insertion entrance 209 to the second recording unit 204. The switching member 220 is positioned at the position for a cut paper sheet when the recording operation is executed with respect to a recording medium fed from the first printing unit 110 side through the insertion entrance 209 and closes the path leading from the second holding unit 202 to the second recording unit 204.

In the second printing unit 120, an insertion detecting sensor (see reference numeral "330" in FIG. 3) whose output value varies according to the presence or absence of the recording medium is provided near the insertion entrance 209, and the switching member 220 is selectively positioned at the position for a continuous paper sheet and the position for a cut paper sheet depending on the output value of the insertion detecting sensor. For example, the switching member is positioned at the position for a continuous paper sheet when the insertion detecting sensor detects no recording medium, and is positioned at the position for a cut paper sheet when the insertion detecting sensor detects the recording medium.

In the housing 130*a* of the first feeding unit 130, an inverting path 224 is provided that communicates (connects) a first opening 221 provided at a position to face the first discharging exit 205 (the position to discharge the recording medium from the first printing unit 110), a second opening 222 provided at a position to face the tray 150, and a third opening provided at a position to face the second feeding unit 140 with each other. The inverting path 224 includes a path 224*a* that communicates the second opening 222 and the third opening 223 with each other, and a path 224*b* that branches near the first opening 221 in the path 224*a* to communicate with the first opening 221. Thus, the inverting path 224 has a substantially T-like shape.

In the inverting path 224, a pair of feeding rollers 225 is provided at a position closer to the second opening 222 than the branching position of the path 224*a* and the path 224*b*. One roller 225*a* of the pair of rollers 225*a* and 225*b* constituting the pair of feeding rollers 225 is coupled with a driving source (see FIG. 3) such as a motor to drive the one roller 225*a*, and is coupled with a power transmission mechanism (not depicted) that transmits the driving force generated by the driving source to the one roller 225*a*.

The motor to drive the one roller 225*a* is set to be rotatable in both of a forward direction and a reverse direction. The one roller 225*a* can thereby be rotated in both directions to feed the recording medium from the side of the first opening 221 toward the side of the second opening 222 (hereinafter, referred properly to as "first rotation direction") and to feed the recording medium from the side of the second opening 222 toward the side of the third opening 223 (hereinafter, referred properly to as "second rotation direction"). The one roller 225*a* is rotated in a direction according to the rotation direction of the motor to drive the one roller 225*a*.

The other roller 225*b* of the pair of rollers 225*a* and 225*b* constituting the pair of feeding rollers 225 is urged in the direction to abut the one roller 225*a* by an urging member not depicted. The pair of rollers 225*a* and 225*b* of the pair of feeding rollers 225 are thereby provided in a state where a portion of the outer circumferential face of each of the rollers 225*a* and 225*b* abuts each other. The other roller 225*b* of the pair of feeding rollers 225 rotates in the direction reverse to the rotation direction of the one roller 225*a* associated with the rotation of the one roller 225*a* by the friction against the one roller 225*a*.

The pair of feeding rollers 225 holds and pinches the recording medium between the pair of rollers 225*a* and 225*b* each having a portion of the outer circumferential face thereof abutting that of each other. In a state where the pair of rollers 225*a* and 225*b* holds and pinches the recording medium therebetween, the recording medium is urged by the other roller 225*b* in the direction for the recording medium to abut the one roller 225*a*. In this state, when the one roller 225*a* rotates, the recording medium can be fed in a direction according to the rotation direction of the one roller 225*a* by the friction between the one roller 225*a* and the recording medium.

The pair of feeding rollers 225 is provided at a position whereby, in the first printing unit 110, the distance to a pair of feeding rollers provided closest to the first discharging exit 205 is smaller than the dimension of the recorded matter identified based on a recording instruction received from an external apparatus (see reference numeral "300" in FIG. 3). Thus, feeding force can always be imparted to the recording medium in the printer 100 and the recording medium discharged from the first printing unit 110 can be prevented from remaining in the first feeding unit 130. In the first embodiment, the feeding part according to the present invention can be realized by the pair of feeding rollers 225.

The pair of feeding rollers 225 is provided at a position whereby the distance from the position at which the pair of feeding rollers 225 holds and pinches the recording medium therebetween to the insertion entrance 209 provided on the housing 120*a* of the second printing unit 120 is smaller than the dimension of the recorded matter identified based on a recording instruction received from an external apparatus. Thus, a feeding force can always be imparted to the recording medium in the printer 100 and the recording medium fed from the first feeding unit 130 to the second feeding unit 140 can be prevented from remaining in the first feeding unit 130 or the second feeding unit 140. The recording medium can thereby be fed from the first feeding unit 130 to the second printing unit 120 without providing any feeding unit such as a pair of rollers to feed the recording medium in the second feeding unit 140.

In the inverting path 224, a sorting part 226 is provided at the branching position of the path 224*a* and the path 224*b*. The sorting part 226 is provided at a position to face the first discharging exit 205 through the first opening 221. The sorting part 226 can be realized by, for example, a flap-like member provided having one end fixed and having another end capable of swinging with the one end as the fulcrum thereof. In the first embodiment, hereinafter, the flap-like member realizing the sorting part 226 will be described using the reference numeral "226".

The position of the flap-like member 226 can be arbitrarily switched by the swinging with the fixed one end thereof as the fulcrum, between a first position for communicating the first opening 221 and the second opening 222 with each other and a second position for communicating the second opening 222 and the third opening 223 with each other.

In the housing 140*a* of the second feeding unit 140, a guide path 229 is provided that communicates a fourth opening 227 provided at a position to face the third opening 223 and a fifth opening 228 provided at a position to face the insertion entrance 209 provided on the housing 120*a* of the second printing unit 120, with each other. The second feeding unit 140 includes a guide member 230 that guides the position of the recording medium fed in the guide path 229. In the first embodiment, a guiding part according to the present invention can be realized by the guide path 229 and the guide member 230.

In the housing 140*a* of the second feeding unit 140, a discharge path 231 is provided that communicates the second discharging exit 207 and the discharging exit 141 with each other. A pair of rollers 232 arranged facing each other across the discharge path 231 is provided on the discharge path 231. The pair of rollers 232 is provided in a state where a portion of the outer circumferential faces of the rollers abut each other, and the abutting portions hold and pinch the recording medium.

The pair of rollers 232 is not coupled with any power source such as a motor and, when the recording medium discharged from the second printing unit 120 is pinched between the pair of rollers 232 and the recording medium is further fed in this state, the pair of rollers 232 are rotated associated with the movement of the recording medium. The recording medium can be held at the discharging exit 141 by providing the pair of rollers 232.

(Hardware Configuration of Printer 100)

A hardware configuration of the printer 100 of the first embodiment according to the present invention will be described. FIG. 3 is an explanatory diagram of the hardware configuration of the printer 100 of the first embodiment according to the present invention. In FIG. 3, the printer 100 includes a first control system 310 and a second control system 320. The first control system 310 drives and controls the components included in the first printing unit 110. The second control system 320 drives and controls the components included in the second printing unit 120. The first control system 310 and the second control system 320 are each independent from each other and each independently drive and control the component subject to control thereby.

The first control system 310 includes a first microcomputer 311, a first communications interface (I/F) 312, a first driver IC 313, a first motor driver 314, and a first input I/F 315. The components including the first microcomputer 311, the first communication I/F 312, the first driver IC 313, the first motor driver 314, and the first input I/F 315 are connected to each other by a bus 316.

The first microcomputer 311 drives and controls the components included in the first printing unit 110. The first microcomputer 311 can be realized by, for example, a circuit board on which a CPU, a memory such as a ROM or a RAM, and various types of circuits such as an input/output circuit and a timer circuit are mounted.

The first microcomputer 311 executes various types of control programs stored in the memory included in the first microcomputer 311 using the CPU, based on various types of data stored in the memory and various types of data received from the external apparatus 300 through the first communication I/F 312, and thereby drives and controls the components included in the first printing unit 110. In the first microcomputer 311, the CPU uses the RAM as a work area that is used when, for example, image data related to the printing based on recording instruction information is expanded.

The first communication I/F 312 is connected to the external apparatus 300. The first communication I/F 312 may be connected directly to the external apparatus 300 or may be connected thereto through a network. The first communication I/F 312 supervises the interface between the external apparatus 300 and the inside of the first printing unit 110, and controls inputting and outputting of data into/from the first control system 310.

The first driver IC 313 is driven and controlled by the first microcomputer 311. The first driver IC 313 is driven and controlled by the first microcomputer 311 and thereby selectively energizes the electrode wires that correspond to the plural heat generating elements included in the first thermal head 203*a* in the first recording unit 203. The heat generating elements can thereby be selectively heated. The heat generated by the heat generating elements of the first thermal head 203*a* is transmitted to the recording layer of the recording medium through the ink ribbon, the sublimable dye ink provided on the ink ribbon is thereby transferred by sublimation to the recording medium, and thereby, the recording operation for the recording medium can be executed.

The first motor driver 314 is driven and controlled by the first microcomputer 311. The first motor driver 314 is connected to various types of motors 317 such as a motor coupled with the first platen 203*b*, a motor coupled with the grip roller 212 in the first printing unit 110, a motor for driving the movable blade in the first cutter mechanism 214, and a motor coupled with each of the feeding units such as the pair of rollers in the first printing unit 110. The first motor driver 314 drives and controls the various types of motors 317 connected to the first motor driver 314 based on control signals from the first microcomputer 311.

The first input I/F 315 is connected to various types of sensors such as the first recording medium detecting sensor 318 and the first cutting position detecting sensor 319. The various types of sensor may be connected to the first input I/F 315 by a universal serial bus (USB).

The first input I/F 315 outputs to the first microcomputer 311, signals that correspond to the output values from the various types of sensors such as the first recording medium detecting sensor 318 and the first cutting position detecting sensor 319. The first microcomputer 311 drives and controls the components included in the first printing unit 110 based on signals output from the first input I/F 315.

The second control system 320 includes a second microcomputer 321, a second communication I/F 322, a second driver IC 323, a second motor driver 324, and a second input I/F 325. The components including the second microcomputer 321, the second communication I/F 322, the second driver IC 323, the second motor driver 324, and the second input I/F 325 are connected to each other by a bus 326.

The second microcomputer 321, the second communication I/F 322, the second driver IC 323, the second motor driver 324, and the second input I/F 325 included in the second control system 320 are similarly configured respectively to the first microcomputer 311, the first communication I/F 312, the first driver IC 313, the first motor driver 314, and the first input I/F 315 in the first control system 310. The second motor driver 324 drives and controls various types of motors 327 connected to the second motor driver 324.

The second input I/F 325 is connected to various types of sensors such as a second recording medium detecting sensor 328, a second cutting position detecting sensor 329, and an insertion detecting sensor 330. The various types of sensors may be connected to the second input I/F 325 by a universal serial bus (USB).

For example, the external apparatus 300 produces a recording instruction for the printer 100 and outputs the produced recording instruction to the printer 100. The external apparatus 300 can be realized by, for example, a personal computer that is installed in a DPE shop that presents a service of outputting by printing an image taken by a digital camera.

The recording instruction includes, for example, information related to an image and the like to be recorded on the recording medium and a command and the like instructing the recording of the information. For example, the external apparatus 300 outputs a one-side recording instruction instructing a recording operation for one side of the recording medium (one-side recording), a two-side recording instruction instructing a recording operation for both sides of the recording medium (two-side recording), or the like, as the recording instruction.

In outputting the two-side recording instruction, the external apparatus 300 outputs the one-side recording instruction to each of the first printing unit 110 and the second printing unit 120. In outputting the two-side recording instruction, the external apparatus 300 realizes the outputting of the two-side recording instruction by outputting a recording instruction including the information related to an image to be recorded on one recording side (for example, the front side) of the recording sides provided on both sides of the recording medium (hereinafter, referred properly to as "front side recording instruction") to the first printing unit 110, and a recording instruction including the information related to an image to be recorded on the other recording side (for example, the back side) of the recording sides provided on both sides of the recording medium (hereinafter, referred properly to as "back side recording instruction") to the second printing unit 120.

In outputting the two-side recording instruction, the back side recording instruction output by the external apparatus 300 to the second printing unit 120 includes an instruction for the recording operation not for the recording medium held by the second holding unit 202 but for the recording medium inserted through the insertion entrance 209. Alternatively, the back side recording instruction may include an instruction to regulate the rotation of the winding core for the recording medium held by the second holding unit 202 to prevent rotation of the winding core for the two-side recording.

The control of the printer by the external apparatus 300 may be executed by a printer driver installed in the external apparatus 300 or may be executed by a dynamic link library (DLL). A DLL file is a library (plural highly versatile programs) that cannot alone be executed and is automatically concatenated and expanded on the memory during the operations of the printing units such as the recording operations. The DLL in the printer can be realized by a program commonly necessary for the operations of the printing units.

(Recording Operation Executed by Printer 100)

A recording operation executed by the printer 100 of the first embodiment according to the present invention will be described below. As described above, the printer 100 can execute the one-side recording and the two-side recording for the recording medium.

(One-Side Recording)

The recording operation related to the one-side recording will be described as the recording operation executed by the printer 100. FIG. 4, FIG. 5, FIG. 6, and FIG. 7 are explanatory diagrams of the recording operation related to the one-side recording of the recording operations executed by the printer 100 of the first embodiment according to the present invention.

In the one-side recording, the printer 100 first receives a one-side recording instruction from the external apparatus 300. The one-side recording instruction is input to the second printing unit 120. The second printing unit 120 having received the one-side recording instruction positions the switching member 220 at the position for a continuous paper sheet (see FIG. 4).

The second printing unit 120 having received the one-side recording instruction rotates the pair of feeding rollers in the second printing unit 120 in the direction to pull out the recording medium held by the second holding unit 202 to the second feeding path 208. The recording medium held by the second holding unit 202 is thereby pulled out from the second holding unit 202 to the second feeding path 208 (see FIG. 4). The position of the lead end of the recording medium pulled out from the second holding unit 202 to the second feeding path 208 can be detected based on the output value of the second recording medium detecting sensor 328.

Based on the detected position of the lead end of the recording medium, the second printing unit 120 further rotates the pair of feeding rollers in the second printing unit 120 and rotates the grip roller 212 in the forward rotation direction. The pair of feeding rollers and the grip roller 212 are rotated in the forward direction until the position of the lead end of the recording medium whose position of the lead end thereof is detected reaches a starting position of the recording operation set in advance (a printing starting position).

The starting position of the recording operation by the second printing unit 120 (the printing starting position) can be set at a position whereby a length from the lead end of the recording medium pulled out to the second feeding path 208, to the recording position of the second recording unit 204 is larger than the dimension of the recorded matter identified based on the one-side recording instruction received from the external apparatus 300. The second printing unit 120 causes the second thermal head 204*a* to become separated from the second platen 204*b* when the long strip-like recording medium is pulled out from the second holding unit 202.

The second printing unit 120 moves the second thermal head 204*a* toward the second platen 204*b* to cause the second thermal head 204*a* and the second platen 204*b* to hold and pinch the recording medium and the ink ribbon therebetween. In this state, the heat generating elements included in the second thermal head 204*a* are selectively heated based on the one-side recording instruction and the long strip-like recording medium pulled out from the second holding unit 202 is fed to the second feeding path 208 in the direction for the recording medium to be pulled into the second holding unit 202 (see FIG. 5). The heat generated by the heat generating elements included in the second thermal head 204*a* is transmitted to the ink ribbon; the sublimable dye ink provided on the ink ribbon is transferred by sublimation to the recording medium whereby the recording operation can be executed for the recording medium.

In the described recording operation, printing is sequentially executed for the Y, M, and C faces for each color of the ink layers. For example, the recording operation for the first color (for example, yellow (Y)) is executed, the recording operation for the second color (for example, magenta (M)) is executed, and the recording operation for the third color (cyan (C)) is executed. Every time the printer 100 executes the recording operation for each of the colors, the printer 100 pulls out the recording medium to the second feeding path 208 until the lead end of the recording medium pulled into the second holding unit 202 by the recording operation again reaches the printing starting position.

For example, after the recording operation for the first color (for example, yellow (Y)) is executed, the recording medium is pulled to the second feeding path 208 until the lead end of the recording medium reaches the printing starting position. The recording operation for the second color (for example, magenta (M)) is executed and, after the recording operation for the second color (for example, magenta (M)) is executed, the recording medium is pulled to the second feeding path 208 until the lead end of the recording medium reaches the printing starting position. The recording operation for the third color (cyan (C)) is similarly executed.

After the recording operations for all the colors are executed for the one side of the recording medium, an overcoat layer is provided on the recording face for which the recording operations are executed. In the state where the recording medium is pulled to the second feeding path 208 until the lead end of the recording medium for which the recording operation is executed reaches the printing starting position, the second printing unit 120 executes the recording operations and thereby provides the overcoat layer on the recording face for which the recording operations are executed. The overcoat layer is provided on the overall face of the recording face for which the recording operations are executed.

The second printing unit 120 drives and controls the corresponding second motor driver 324 to rotate, in the forward direction, the pair of feeding rollers provided for the second feeding path 208 in the direction with which the recording medium on which the overcoat layer has been provided moves from the second holding unit 202 toward the second discharging exit 207. The second printing unit 120 drives and controls the corresponding second motor driver 324 until the lead end of the recording medium on which the overcoat layer has been provided is pulled to the predetermined position passing through the cutting position of the second cutter mechanism 217. For example, the second printing unit 120 drives and controls the corresponding second motor driver 324 to rotate, in the forward direction, the pair of feeding rollers provided for the second feeding path 208 until the border between the recorded portion toward the lead end of the recording medium for which the one-side recording is executed and a non-recorded portion reaches the cutting position of the second cutter mechanism 217.

In the described recording operations, the energy applied to the recording face of the recording medium for the recording operation (printing energy) can be adjusted by adjusting the energization amount (an energization time period) for the heat generating elements included in the second thermal head 204*a* and the feeding speed of the recording medium for the recording operation (the printing energy). The curve caused by the winding and remaining in the recording medium, caused by using the wound long strip-like recording medium can thereby be removed and the recording medium can be set to be flat without any curve.

Figure 6:
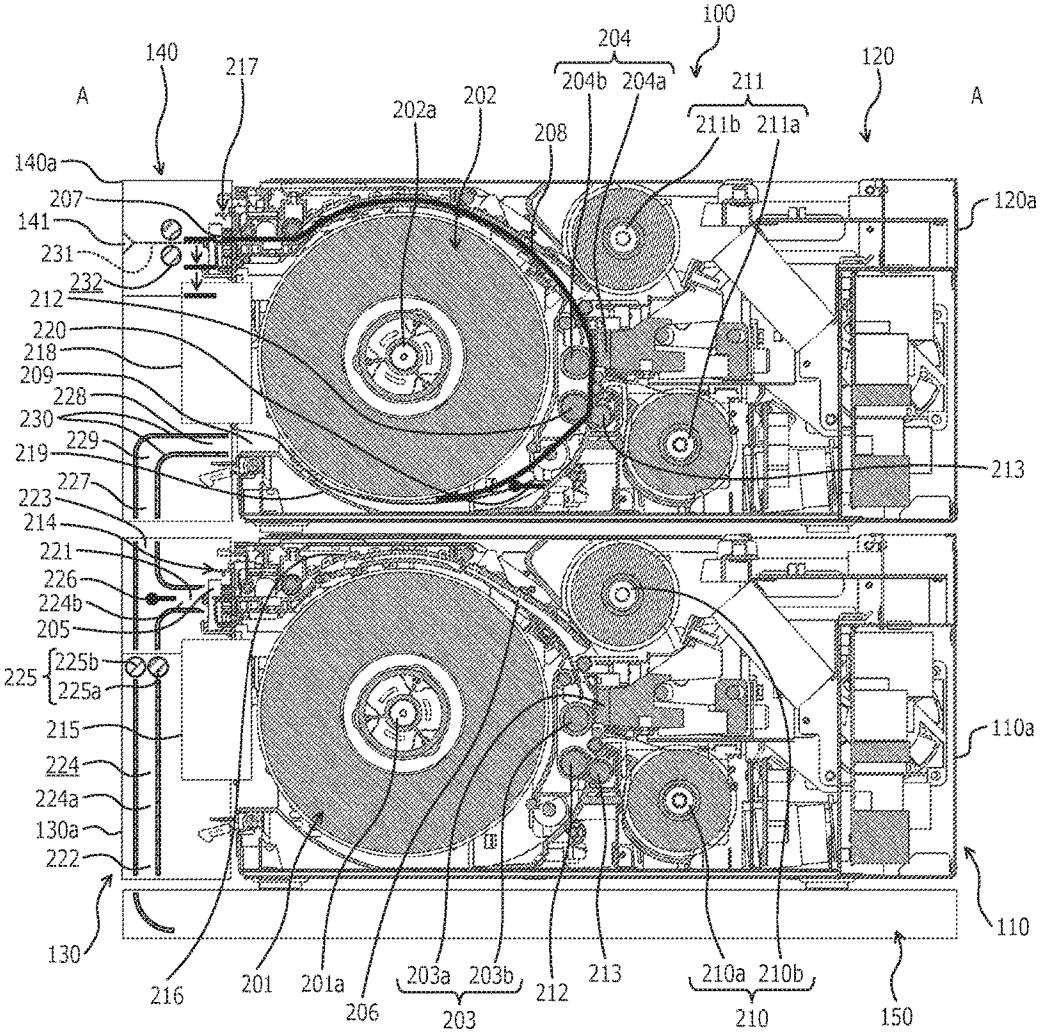
FIG. 6 is an explanatory diagram (part 3) of the recording operation related to the one-side recording of the recording operations executed by the printer of the first embodiment according to the present invention.

In a state where the recording medium on which the overcoat layer has been provided is pulled to the predetermined position, the movable blade is caused to operate by driving and controlling the motor driver 324 of the motor for the movable blade in the second cutter mechanism 217 (see FIG. 6). The margin at the lead end of the recording medium for which the one-side recording is executed is thereby cut off from the recorded matter. The margin piece produced by this cutting is accommodated in the second cutting waste accommodating unit 218.

The second printing unit 120 drives and controls the corresponding second motor driver 324 so that the pair of feeding rollers rotate in the direction by which the recording medium for which the one-side recording has been executed and from which the margin at the lead end of the recording medium has been cut off is fed toward the second discharging exit 207. The printer 100 drives and controls the corresponding second motor driver 324 until the recorded portion of the recording medium of the recording medium for which the one-side recording has been executed is fed to a predetermined position passing through the cutting position of the second cutter mechanism 217. For example, the printer 100 drives and controls the corresponding second motor driver 324 to rotate, in the forward direction, the pair of feeding rollers provided in the second feeding path 208 until the border between the recorded portion on the side toward the tail end of the recording medium for which the one-side recording has been executed and a non-recorded portion thereof reaches the cutting position of the second cutter mechanism 217.

Figure 7:
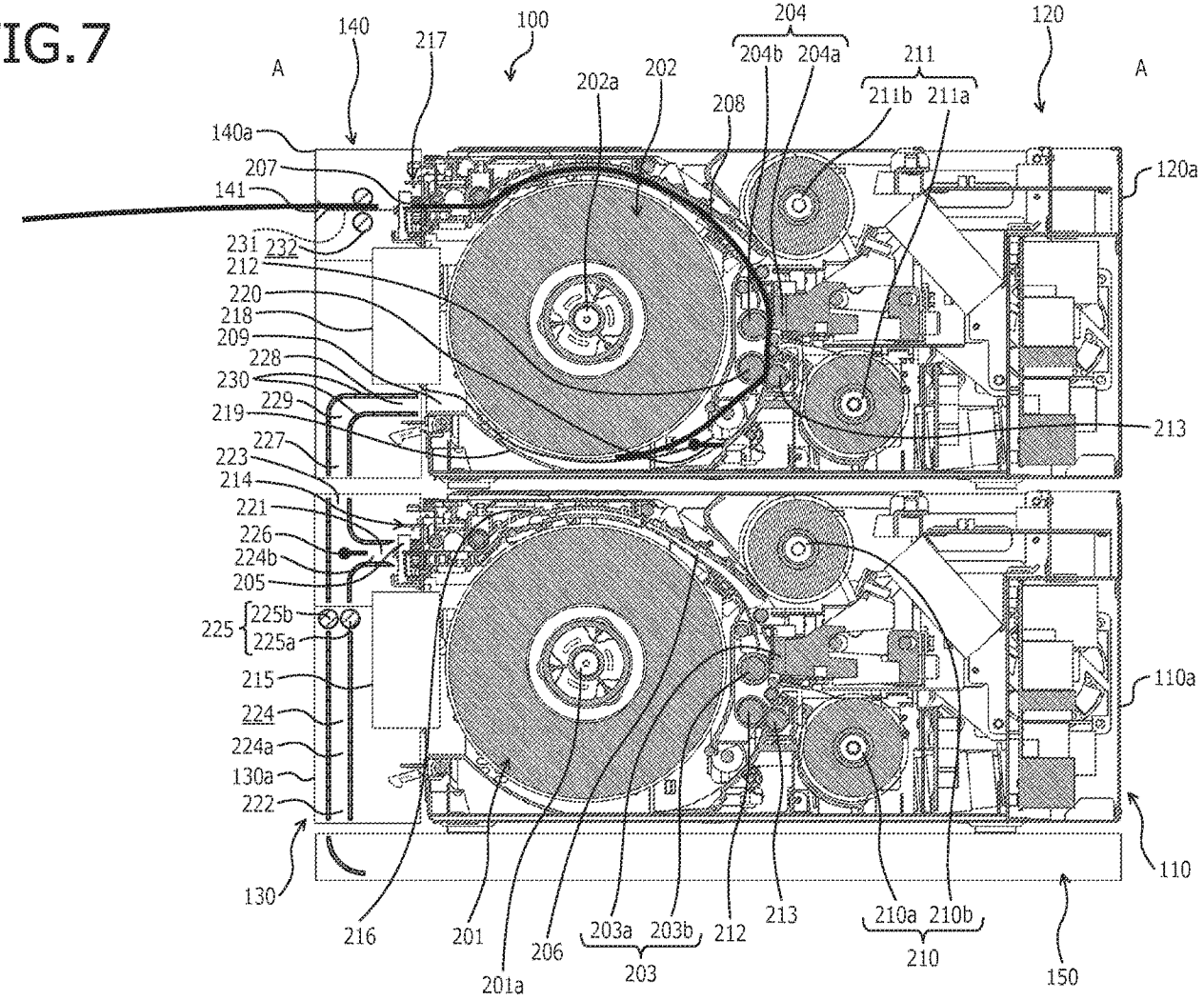
FIG. 7 is an explanatory diagram (part 4) of the recording operation related to the one-side recording of the recording operations executed by the printer of the first embodiment according to the present invention.
Figure 8:
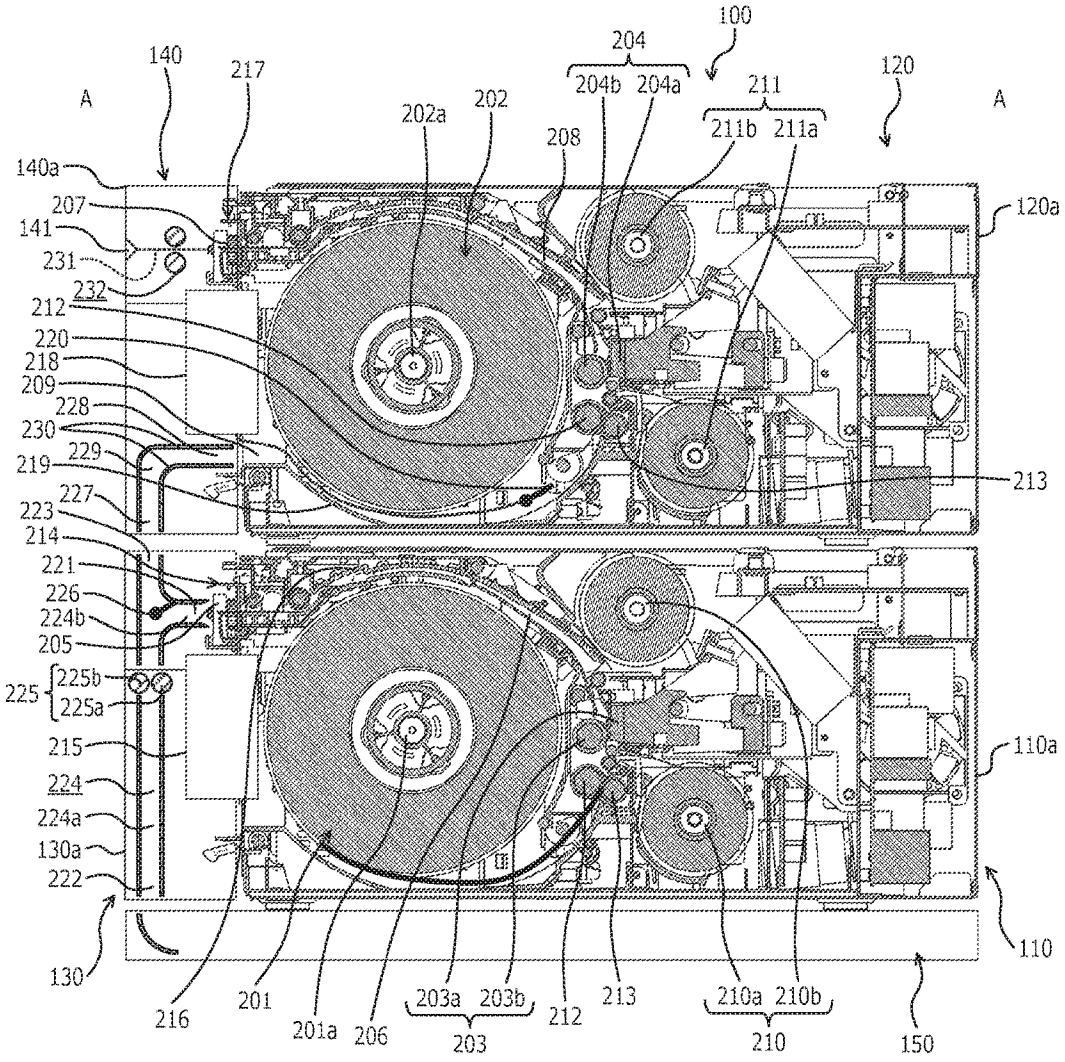
FIG. 8 is an explanatory diagram (part 1) of a recording operation related to two-side recording of the recording operations executed by the printer of the first embodiment according to the present invention.
Figure 9:
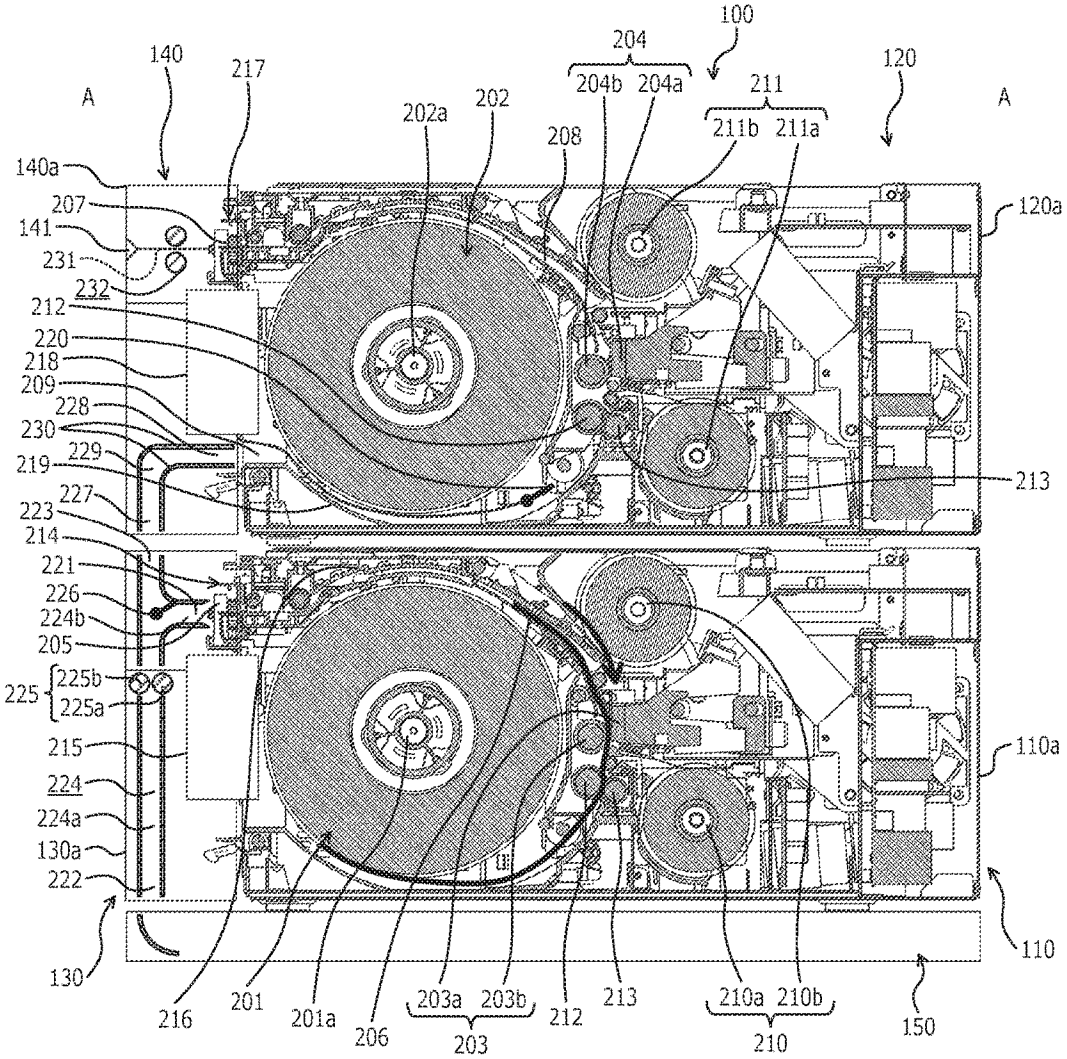
FIG. 9 is an explanatory diagram (part 2) of the recording operation related to the two-side recording of the recording operations executed by the printer of the first embodiment according to the present invention.

In this state, the movable blade is again caused to operate by driving and controlling the second motor driver 324 of the motor for the movable blade in the second cutter mechanism 217 (see FIG. 7). The border between the recorded portion of the recording medium for which the one-side recording is executed and the non-recorded portion thereof is thereby cut. In this manner, a recorded matter having no margin (a recorded matter having no frame) can be provided by cutting both ends of the recorded portion the recording medium for which the one-side recording has been executed.

The recording medium from which the margins on both ends have been cut therefrom becomes a paper sheet-like recording medium cut from the long strip-like recording medium. The second printing unit 120 feeds the cut paper sheet-like recording medium to the second feeding unit 140 through the second discharging exit 207 using the pair of feeding rollers, and discharges the cut paper sheet-like recording medium from the discharging exit 141 provided on the housing 140*a* of the second feeding unit 140 to the exterior of the printer 100.

In the printer 100 of the first embodiment, the second printing unit 120 is stacked on the upper side in the vertical direction of the first printing unit 110 and space can be secured on the front side of the printer and under the discharging exit 141. Even when plural recorded matters are consecutively discharged from the discharging exit 141, the plural recorded matters can be accumulated in a stacked form in this space.

(Two-Side Recording)

The recording operation related to the two-side recording will be described below as the recording operation executed by the printer 100. FIG. 8, FIG. 9, FIG. 10, FIG. 11, FIG. 12, FIG. 13, and FIG. 14 are explanatory diagrams of the recording operation related to the two-side recording of the recording operations executed by the printer 100 of the first embodiment according to the present invention.

In the two-side recording, the printer 100 first receives a two-side recording instruction from the external apparatus 300. As described above, in the two-side recording, a front side recording instruction is input to the first printing unit 110 and a back side recording instruction is input to the second printing unit 120. The first printing unit 110 having received the front side recording instruction positions the flap-like member 226 at the first position. The second printing unit 120 having received the back side recording instruction positions the switching member 220 at the position for a cut paper sheet (see FIG. 8).

The first printing unit 110 having received the recording instruction related to the double-side recording instruction rotates the pair of feeding rollers in the first printing unit 110 in the direction to pull out the recording medium held by the first holding unit 201 to the first feeding path 206. The recording medium held by the first holding unit 201 is thereby pulled out from the first holding unit 201 to the first feeding path 206 (see FIG. 8). The position of the lead end of the recording medium pulled out from the first holding unit 201 to the first feeding path 206 can be determined based on the output value of the first recording medium detecting sensor 318.

Based on the detected position of the lead end of the recording medium, the printing unit 110 further rotates the pair of feeding rollers in the first printing unit 110 and rotates the grip roller 212 in the forward rotation direction. The pair of feeding rollers and the grip roller 212 are rotated in the forward direction until the position of the lead end of the recording medium whose position of the lead end thereof is detected reaches a starting position of the recording operation set in advance (a printing starting position).

The starting position of the recording operation in the first printing unit 110 (the printing starting position) can be set at a position whereby the length from the lead end of the recording medium pulled out to the first feeding path 206 to the recording position of the first recording unit 203 is larger than the dimension of the recorded matter identified based on the front side recording instruction received from the external apparatus 300. The first printing unit 110 causes the first thermal head 203*a* to be separated from the first platen 203*b* when the long strip-like recording medium is pulled out from the first holding unit 201.

The first printing unit 110 moves the first thermal head 203*a* toward the first platen 203*b*, and the recording medium and the ink ribbon are held and pinched by the first thermal head 203*a* and the first platen 203*b*. In this state, the heat generating elements included in the first thermal head 203*a* are selectively heated based on the front side recording instruction, and the recording medium pulled out from the first holding unit 201 is fed to the first feeding path 206 in the direction for the recording medium to be pulled into the first holding unit 201 (see FIG. 9).

The heat generated by the heat generating elements included in the first thermal head 203*a* is transmitted to the ink ribbon, the sublimable dye ink provided on the ink ribbon is transferred by sublimation to the recording medium, whereby the recording operation can be executed for the recording medium. In the recording operation by the first printing unit 110, printing is sequentially executed for the Y, M, and C faces for each color of the ink layer similarly to the recording operation by the second printing unit 120.

Similarly to the recording operations by the second printing unit 120, after the recording operations for all the colors are executed for the one side of the recording medium, an overcoat layer is provided on the recording face (the front side) of the recording medium for which the recording operations have been executed on one side. Similarly to the recording operations by the second printing unit 120, the overcoat layer is provided on the overall face of the recording face (the front side) for which the recording operations have been executed.

The first printing unit 110 drives and controls the corresponding first motor driver 314 to rotate the pair of feeding rollers provided in the first feeding path 206 in the direction whereby the recording medium on which the overcoat layer has been provided moves from the first holding unit 201 toward the first discharging exit 205. The first printing unit 110 drives and controls the corresponding first motor driver 314 until the lead end of the recording medium on which the overcoat layer has been provided is pulled out to the predetermined position passing through the cutting position of the first cutter mechanism 214. For example, the first printing unit 110 drives and controls the corresponding first motor driver 314 to rotate, in the forward direction, the pair of feeding rollers provided in the first feeding path 206 until the border between the recorded portion on the side toward the lead end of the recording medium for which the recording operation has been executed for one side (the front side) and a non-recorded portion reaches the cutting position of the first cutter mechanism 214.

Figure 10:
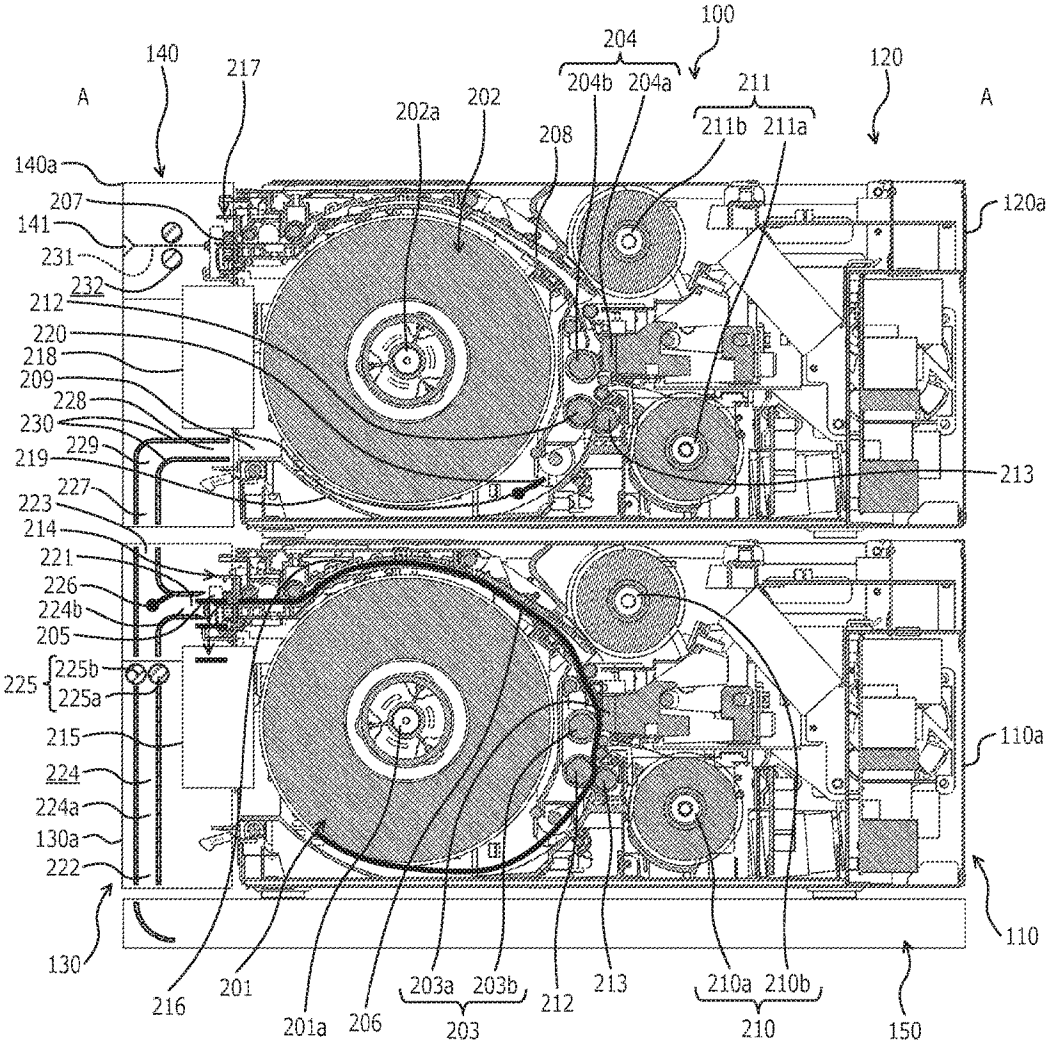
FIG. 10 is an explanatory diagram (part 3) of the recording operation related to the two-side recording of the recording operations executed by the printer of the first embodiment according to the present invention.

In a state where the recording medium on which the overcoat layer has been provided is pulled to the predetermined position, the movable blade is caused to operate by driving and controlling the first motor driver 314 of the motor for the movable blade in the first cutter mechanism 214 (see FIG. 10). The margin at the lead end of the recording medium for which the recording operation has been executed for one-side is thereby cut off from the recorded matter. The margin piece produced by this cutting is accommodated in the first cutting waste accommodating unit 215.

In the two-side recording, the recorded matter is not limited to the recorded matter for which the recording operation has been executed for one side (the front side) and from which the margin at the lead end of the recording medium has been fully cut off. For example, the cutting may be executed in a state where a portion of the margin at the lead end of the recording medium for which the recording operation has been executed for one side (the front side) remains, or the margin at the lead end of the recording medium for which the recording operation has been executed for one side may remain without being cut off. In the recording operation for the back side, a load applied to the end portion of the recording medium can be buffered by the margin portion when the recording medium is inserted between the grip roller 212 and the pinch roller 213 and between the first thermal head 203*a* and the first platen 203*b* in the first recording unit 203, and damage of the recorded matter can thereby be prevented, by causing the margin to remain.

Figure 11:
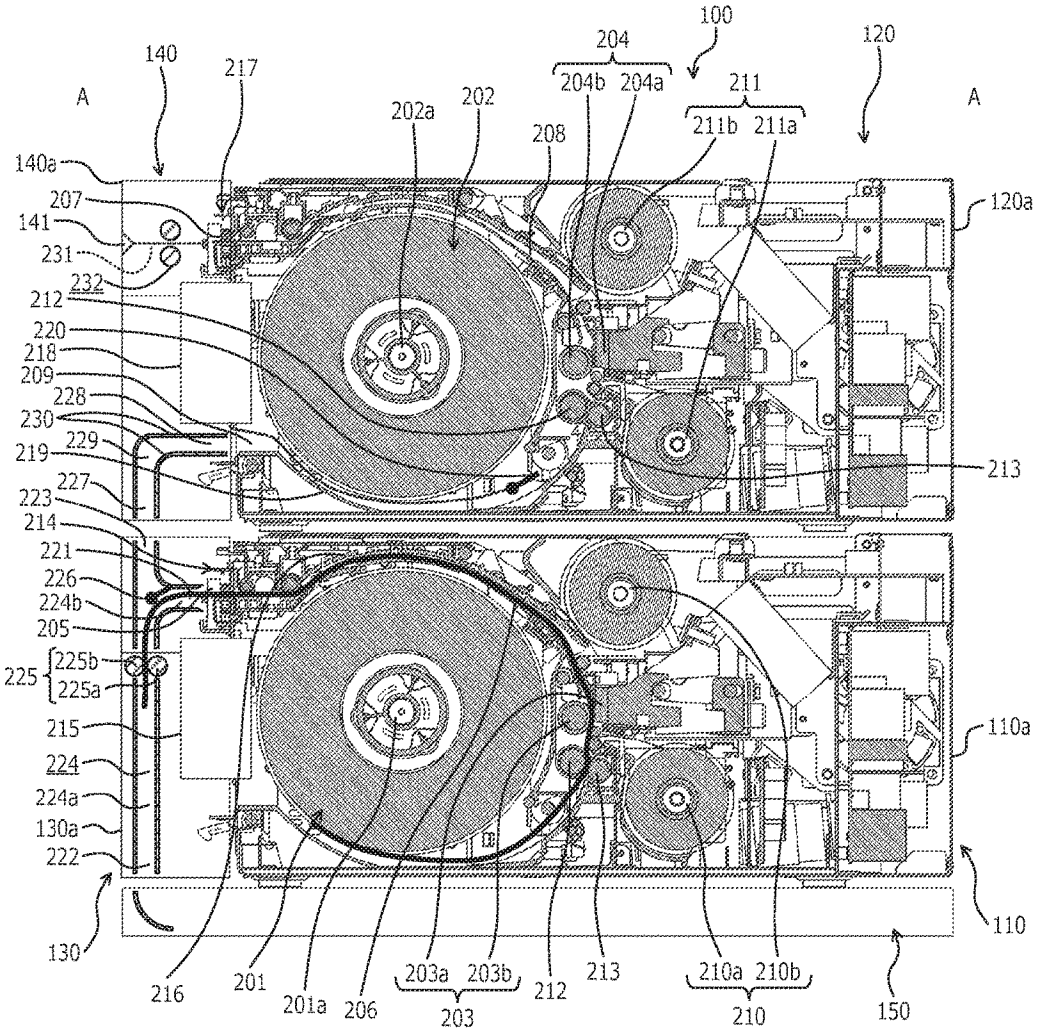
FIG. 11 is an explanatory diagram (part 4) of the recording operation related to the two-side recording of the recording operations executed by the printer of the first embodiment according to the present invention.
Figure 12:
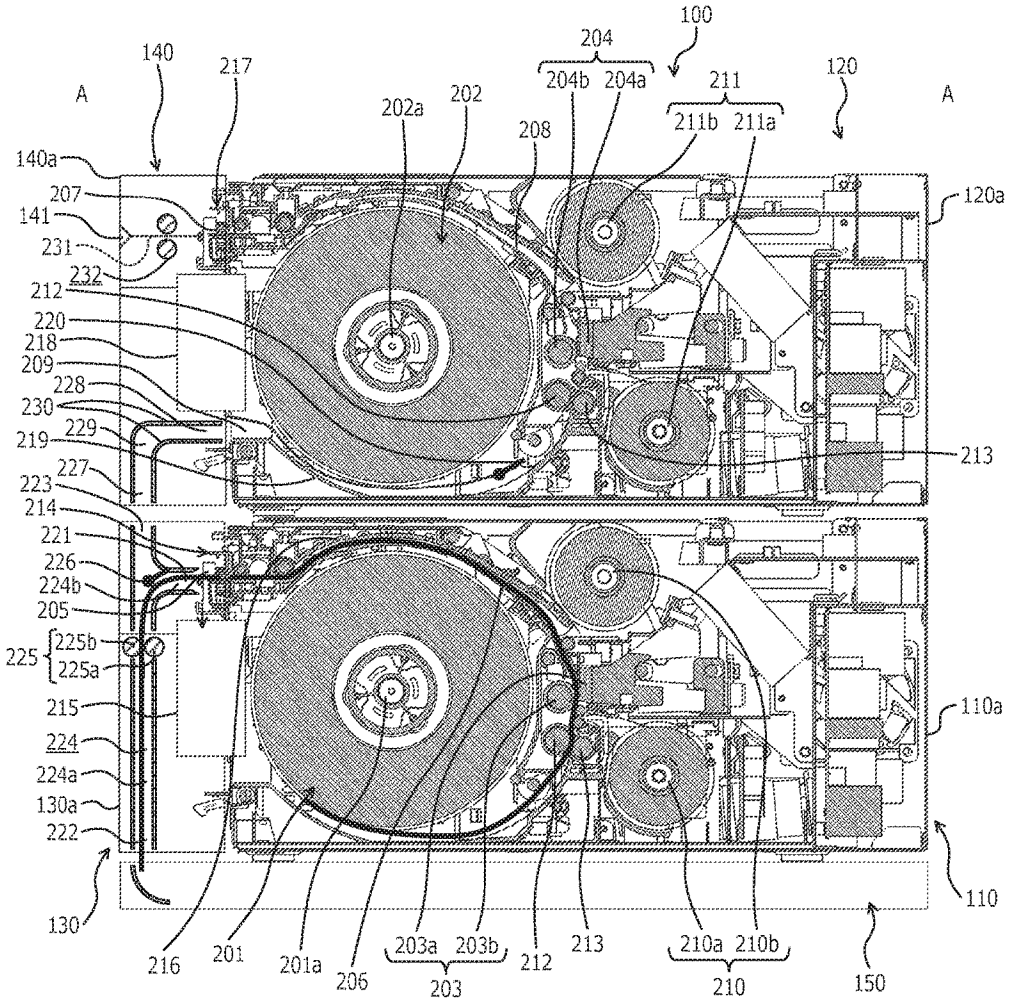
FIG. 12 is an explanatory diagram (part 5) of the recording operation related to the two-side recording of the recording operations executed by the printer of the first embodiment according to the present invention.
Figure 13:
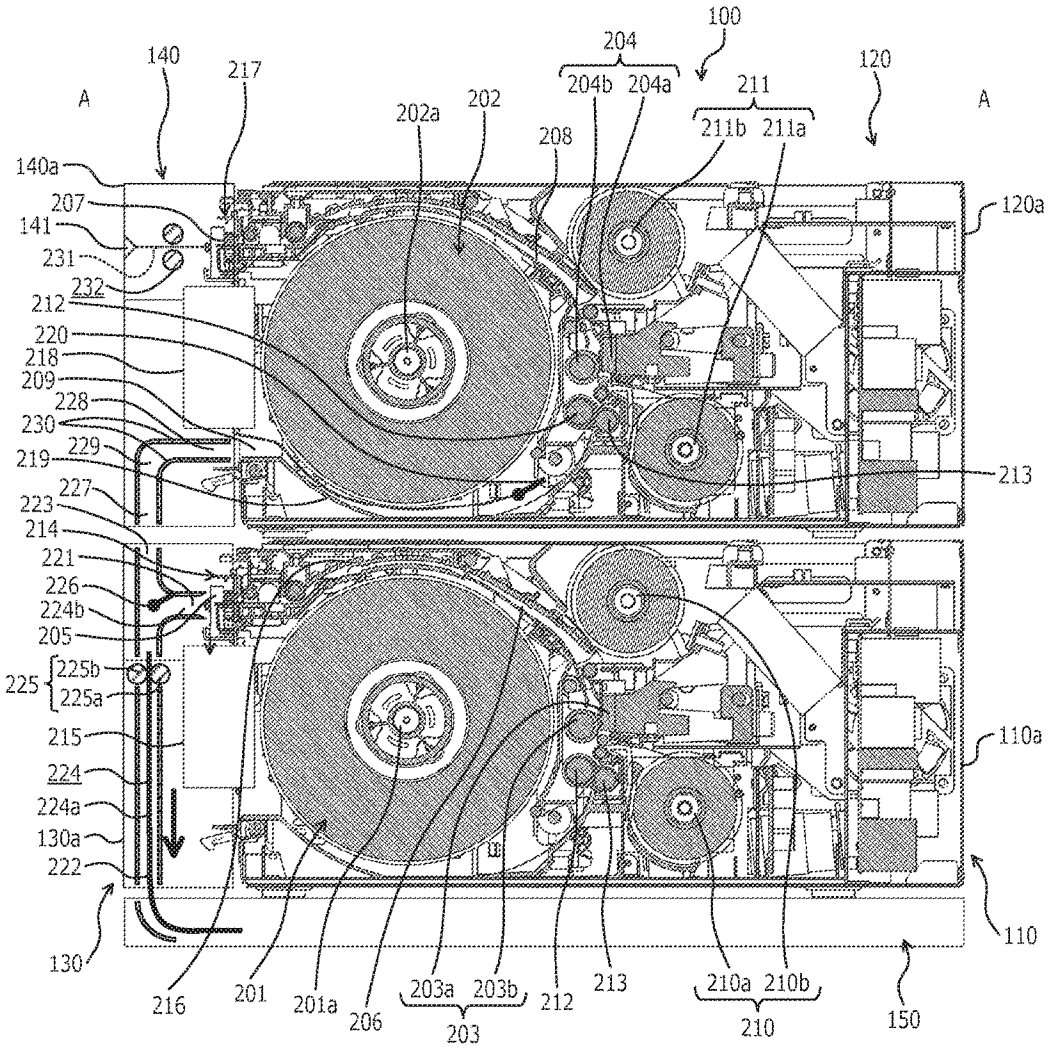
FIG. 13 is an explanatory diagram (part 6) of the recording operation related to the two-side recording of the recording operations executed by the printer of the first embodiment according to the present invention.

The first printing unit 110 drives and controls the corresponding first motor driver 314 to rotate the pair of feeding rollers, and the recording medium for which the recording operation has been executed for one side (the front side) and from which the margin at the lead end has been cut off is thereby fed toward the first discharging exit 205 (see FIG. 11). The printer 100 drives and controls the corresponding first motor driver 314 until the recorded portion of the recording medium passes through the cutting position of the first cutter mechanism 214 and the recording medium for which the recording operation has been executed for the front side is fed to a predetermined position. For example, the printer 100 drives and controls the corresponding first motor driver 314 until the border between the recorded portion positioned on the side opposite to the lead end of the recorded portion of the recording medium for which the recording operation has been executed for the front side, and the non-recorded portion (hereinafter, properly referred to as "tail end") is fed to the cutting position of the first cutter mechanism 214.

In this state, the printer 100 drives and controls the first motor driver 314 of the motor for the movable blade in the first cutter mechanism 214 to cause the movable blade to again operate. The border between the recorded portion and the non-recorded portion of the recording medium for which the one-side recording has been executed is cut and a cut paper sheet-like recording medium for which the recording operation has been executed for one side (the front side) is formed. In this manner, the recorded matter having no margin (the recorded matter having no frame) can be provided by cutting off both ends of the recorded portion of the recording medium for which the one-side recording has been executed.

In the two-side recording, the cutting is executed in a state where the margin on the tail end of the recording medium for which the one-side recording has been executed is caused to remain so that a predetermined length is obtained without cutting off the overall margin on the tail end of the recording medium for which the one-side recording has been executed. For example, the tail end of the recording medium for which the one-side recording has been executed is cut off in a state where the margin remains having a length from the position at which the grip roller 212 and the pinch roller 213 abut each other to the recording position of the first recording unit 203.

In the recording operation for the back side, the recording medium can also be held and pinched by the grip roller 212 and the pinch roller 213, and the recording position relative to the recording medium can also be adjusted precisely by causing the margin to remain as described above. The load applied to the end portion of the recording medium can also be buffered by the margin portion when the recording medium is inserted between the grip roller 212 and the pinch roller 213, and between the first thermal head 203*a* and the first platen 203*b* in the first recording unit 203, and damage of the recorded matter can thereby be prevented, by causing the margin to remain.

The first feeding unit 130 positions the flap-like member 226 at the first position during the execution of the recording operation by the first printing unit 110. In the cutting of the recording medium by the first cutter mechanism 214, the recording medium can thereby be guided from the first opening 221 of the first feeding unit 130 to the side of the second opening 222 and damage of the recording medium caused by hooking of the recording medium by the flap-like member 226 or the like can be prevented when the recording medium shoots out from the housing 110*a* of the first printing unit 110 with the lead end thereof ahead (see FIG. 11).

The cut paper sheet-like recording medium for which the recording operation has been executed for one-side (the front side) is fed to the first feeding unit 130. Because the flap-like member 226 in the first feeding unit 130 is positioned at the first position, the cut paper sheet-like recording medium for which the recording operation has been executed for one-side (the front side) is fed to the first feeding unit 130, through the first discharging exit 205 and the first opening 221 starting with the side of the lead end of the recording medium (see FIG. 12). The recording medium fed to the first feeding unit 130 is thereby guided from the first opening 221 toward the second opening 222.

As described above, the pair of feeding rollers 225 is provided at a position whereby the distance therefrom to the pair of feeding rollers provided closest to the first discharging exit 205 in the first printing unit 110 is smaller than the dimension of the recorded matter identified based on the recording instruction received from the external apparatus 300, and the cut paper sheet-like recording medium for which the recording operation has been executed for one-side (the front side) is therefore held and pinched by the pair of feeding rollers 225 at the time at which the tail end side is cut off.

After cutting off the tail end of the recording medium using the first cutter mechanism 214, the printer 100 rotates, in the forward direction, the one roller 225*a* included in the pair of feeding rollers 225 in the first feeding unit 130. The recording medium for which the one-side recording has been executed and whose tail end side has been cut off is thereby fed from the first opening 221 toward the second opening 222. The recording medium fed from the first opening 221 to the second opening 222 is fed to the tray 150 through the second opening 222 starting with the lead end thereof, according to the length of the recording medium (see FIG. 13).

The printer 100 rotates, in the forward direction, the one roller 225*a* included in the pair of feeding rollers 225 based on the output value of the first cutting position detecting sensor 318 from the time when the tail end of the cut paper sheet-like recording medium for which the recording operation has been executed for one-side (the front side) passes through the cutting position of the first cutter mechanism 214 until the recording medium is fed by a predetermined length from the first opening 221 toward the second opening 222. For example, the printer 100 rotates, in the forward direction, the one roller 225*a* included in the pair of feeding rollers 225 until the tail end of the recording medium cut by the first cutter mechanism 214 passes through the position of the lead end of the flap-like member 226 positioned at the first position.

Figure 14:
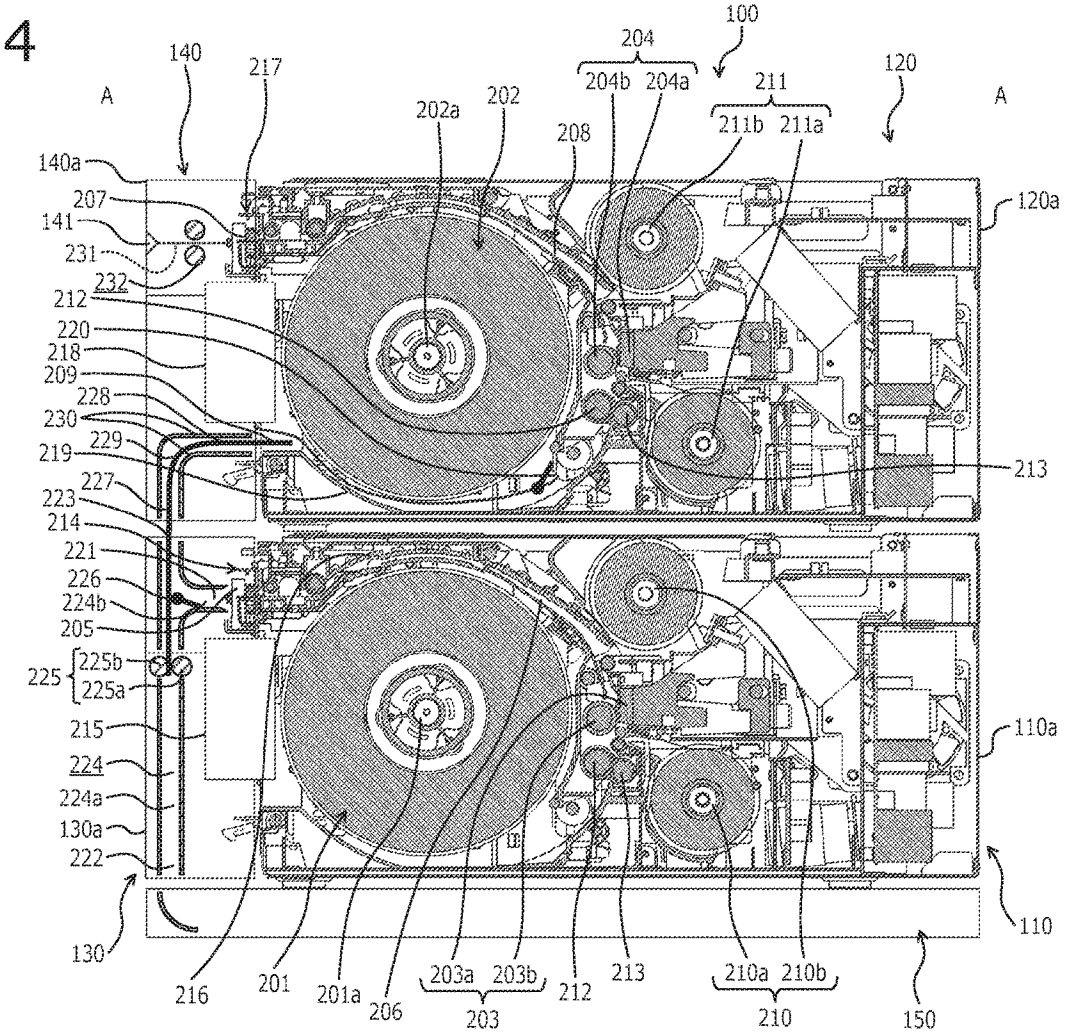
FIG. 14 is an explanatory diagram (part 7) of the recording operation related to the two-side recording of the recording operations executed by the printer of the first embodiment according to the present invention.

The printer 100 positions the flap-like member 226 at the second position and rotates, in the reverse direction, the one roller 225*a* included in the pair of feeding rollers 225 in the first feeding unit 130 (see FIG. 14). The cut paper sheet-like recording medium for which the recording operation has been executed for one-side (the front side) is thereby fed from the second opening 222 toward the third opening 223.

The printer 100 rotates, in the reverse direction, the one roller 225*a* included in the pair of feeding rollers 225 such that the one roller 225*a* rotates by the number of rotations that is larger than that necessary to feed the recording medium having a length corresponding to the dimension of the recorded matter identified based on the recording instruction received from the external apparatus 300. The side facing the first thermal head 203*a* and the side facing the second thermal head 204*a* of the recording medium can be inverted to each other by feeding the recording medium fed to the space in the tray 150 starting with the lead end thereof, and to the second printing unit 120 starting with the tail end thereof as described above.

When the second printing unit 120 detects the recording medium inserted from the insertion entrance 209 based on the output value of the insertion detecting sensor 330 provided near the insertion entrance 209, the second printing unit 120 rotates the pair of feeding rollers in the forward direction to execute the recording operation same as the recording operation executed for the above one-side recording based on the back side recording instruction received from the external apparatus 300. Because the side facing the first thermal head 203*a* and the side facing the second thermal head 204*a* of the recording medium are inverted to each other, the second printing unit 120 executes the recording operation same as that for the one-side recording and the recording can thereby be executed for both sides of the recording medium.

As described above, in the recording operation by the first printing unit 110, when the recording medium that is to be recorded on is cut off with the margin remaining at the lead end of the recording medium, the second printing unit 120 cuts off the margin at the lead end of the recording medium using the second cutter mechanism 217 for the recording operation related to the two-side recording.

In the recording operation by the second printing unit 120 related to the two-side recording, the margin on the tail end of the recording medium that is to be recorded on is subsequently cut off. In the two-side recording, a recorded matter having no margin (a recorded matter having no frame) can thereby be also provided. The recording medium whose margins on both ends thereof are cut off and for which the two-side recording has been executed is fed to the second feeding unit 140 through the second discharging exit 207 and is discharged to the exterior of the printer from the discharging exit 141 provided on the housing 140*a* of the second feeding unit 140.

In the first embodiment, the printer is described where the first holding unit 201 of the first printing unit 110 holds the recording medium that is suitable for the two-side recording, the recording operation is executed by the first recording unit 203 for the front side of the recording medium held by the first holding unit 201, the recording operation is thereafter executed by the second recording unit 204 for the back side of the recording medium in the second recording unit 204 of the second printing unit 120, whereby the two-side recording is executed. In the first embodiment, the printer is described where the ribbon unit 210 in the first printing unit 110 and the ribbon unit 211 in the second printing unit 120 each use a same ink ribbon as that of each other to execute the recording operation.

The use of the printer 100 according to the present invention is not limited to the use described in the first embodiment and the printer 100 is usable for various types of uses. For example, the first holding unit 201 may hold a recording medium suitable for the one-side recording, and the type of ink ribbon held by the ribbon unit 210 in the first printing unit 110 and the type of ink ribbon held by the ribbon unit 211 in the second printing unit 120 may be different from each other.

In this case, for example, the ribbon unit in the first printing unit 110 holds the ink ribbon as above and the ribbon unit in the second printing unit 120 holds an ink ribbon that includes an ink layer for a color (a special color) other than yellow (Y), magenta (M), and cyan (C). For example, gold, silver, a hologram color, black, or the like is usable as the special color. The hologram color can be recorded by using an ink ribbon that includes an ink layer whose surface has plural fine grooves provided thereon. In this case, the special color can be additionally recorded on the recording side of the recording medium for which the one-side recording is executed by the first printing unit 110.

When the printer 100 is employed for this use, the first feeding unit 130 positions the flap-like member 226 at the second position by the time when the recording operation by the first printing unit 110 is completed. The recording medium for which the one-side recording is executed by the first printing unit 110 can thereby be fed to the second printing unit 120 in a state where the same side as the recording side facing the recording position of the first recording unit 203 faces the recording position of the second recording unit 204.

In this use, the type of ink ribbon held by the ribbon unit 210 in the first printing unit 110 and the type of ink ribbon held by the ribbon unit 211 in the second printing unit 120 may be caused to differ from each other by, for example, holding the recording medium suitable for the two-side recording by the first holding unit 201 and holding an ink ribbon including an ink layer for black by the ribbon unit in the second printing unit 120.

In this case, a recording operation for one color to be black can be executed on the back side of the recording medium for which the one-side recording is executed by the first printing unit 110. This use can be applied to, for example, a recording operation for New Year postcards. With this use, when recording an image on one side of the recording medium, an address can be recorded on the other side of the recording medium for which the recording of the image has already been executed for one side.

The printer formed by stacking the first printing unit 110 and the second printing unit 120 on each other is described in the first embodiment, however, the number of printing units to be stacked on each other in the printer is not limited to two. For example, the printer may be configured by stacking three or more printing units on each other.

In the printer configured by stacking three or more printing units on each other, for example, the printing unit provided at the lowest position in the vertical direction holds a recording medium suitable for the two-side recording and a feeding unit similar to the first feeding unit 130 is attached to each of the printing units other than that at the highest position in the vertical direction.

In this printer, the two-side recording can be executed and the recording for the special color can be executed for both sides of the recording medium. For example, recording using yellow (Y), magenta (M), and cyan (C) (ordinary recording) can be executed for both sides of the recording medium and recording using the special color can be further executed for both sides of the recording medium.

With the printer configured by stacking three or more printing units on each other, for example, a recording operation for the ordinary recording and the recording using the special color can be executed for the one side of the recording medium and an address can be recorded in black on the other side of the recording medium.

The tray 150 is provided at the lowest position of the two printing units 110 and 120 stacked on each other and, when the sides of the recording medium are inverted to each other, the recording medium is accommodated in the space on the inner side of the tray 150 without folding the recording medium in the first embodiment, however, the position of the space is not limited to the lowest position of the two printing units 110 and 120 stacked on each other. A space similar to the space secured by the tray 150 may be secured by, for example, arranging the tray 150 between the two printing units 110 and 120 stacked on each other.

In this case, to invert the sides of the recording medium for which the recording operation is executed by the printing unit 110 arranged on the lower side in the vertical direction, the recording medium can temporarily be fed to the space between the printing units 110 and 120. In this case, to invert the sides of the recording medium for which the recording operation is executed by the printing unit 120 arranged on the upper side in the vertical direction, the recording medium may temporarily be fed.

A feeding unit including the inverting path 224 similar to the first feeding unit 130 can thereby be attached not only to the printing unit 110 arranged on the lower side in the vertical direction but also to the printing unit 120 arranged on the upper side in the vertical direction, and the sides of the recording medium can be inverted to each other in each of the printing units 110 and 120. Recording operations each more specifically coping with the use by each user can thereby be executed and improvement of the degree of freedom can be facilitated.

The two printing units 110 and 120 are stacked on each other in the vertical direction, the printing unit 110 arranged on the lower side in the vertical direction executes the recording operation for the one side (the front side) of the recording medium, and the printing unit 120 arranged on the upper side in the vertical direction executes the recording operation for the other side (the back side) of the recording medium in the first embodiment, however, the direction to feed the recording medium is not limited to this. For example, the printing unit 120 arranged on the upper side in the vertical direction may execute the recording operation for one side (the front side) of the recording medium and the printing unit 120 arranged on the upper side in the vertical direction may execute the recording operation for the other side (the back side) of the recording medium.

As described above, the first feeding unit 130 (and the second feeding unit 140) realizing the feeding unit according to the present invention includes the first holding unit 201 that holds the long strip-like recording medium in a wound state and the first recording unit 203 that executes the recording operation for the recording medium pulled out from the first holding unit 201, and is provided in the first printing unit 110 that cuts the long strip-like recording medium for which the recording operation has been executed and discharges the cut recording medium.

The first feeding unit 130 (and the second feeding unit 140) includes the flap-like member 226 realizing the sorting part that sorts the recording medium discharged from the first printing unit 110 to the second printing unit 120 stacked on the first printing unit 110 or to the side opposite to that of the second printing unit 120, the guide path 229 that guides the recording medium sorted to the second printing unit 120 side by the flap-like member 226 for the recording medium to be supplied to the position to which another recording medium held by the second printing unit 120 is pulled out along the direction identical to the direction to pull out the other recording medium, and the pair of feeding rollers 225 that accommodate the recording medium sorted by the flap-like member 226 to the side opposite to that of the second printing unit 120 until the tail end of the recording medium passes through the second printing unit 120 and that feed the recording medium to the guide path 229 starting with the tail end thereof when the tail end thereof passes through the flap-like member 226.

The first feeding unit 130 (and the second feeding unit 140) is characterized in that the flap-like member 226 sorts the recording medium fed by the pair of feeding rollers 225 to the second printing unit 120 side.

According to the first feeding unit 130 and the second feeding unit 140 each realizing the feeding unit of the present invention, the recording operation by the second printing unit 120 can be additionally executed for the recording side receiving the recording operation by the first printing unit 110, by supplying the recording medium discharged from the first printing unit 110 to the position to which the recording medium held by the second holding unit 202 is pulled out, along the direction identical to the direction to pull out the recording medium.

For example, the special color (for example, gold, silver, a hologram color, or black) unusable by one printer (for example, the first printing unit 110 alone or the second printing unit 120 alone) can thereby be recorded and special processing such as foil stamping can be executed.

Ordinarily, a printer executing the recording of the special color and special processing such as foil stamping is developed and designed to be dedicated to the recording of the special color and the special processing when necessary. The dedicated printer needs a high cost for design and development, and the dedicated printer needs a high cost for manufacture because of a small number for prevalence.

In contrast, according to the first feeding unit 130 and the second feeding unit 140, the first printing unit 110 and the second printing unit 120 having a same structure can be used being stacked on each other, and the recording of the special color and the special processing such as foil stamping can therefore be executed without developing a new printer.

As described above, according to the first feeding unit 130 and the second feeding unit 140 of the first embodiment of the present invention, the printer 100 can be provided that has a high degree of freedom and that can execute the recording operation according to the use for each user without any cost for the development, the design, and the manufacture thereof.

According to the first feeding unit 130 and the second feeding unit 140 of the first embodiment of the present invention, the recording medium sorted by the flap-like member 226 to the side opposite to that of the second printing unit 140 can be supplied to the second printing unit 120 starting with the tail end thereof that is on the side opposite to that of the lead end at the time of discharge from the first printing unit 110.

Because the first printing unit 110 and the second printing unit 120 have an identical configuration, the recording side for the recording unit of the second printing unit 120 can be inverted relative to the recording side for the recording unit of the printer by supplying the recording medium discharged from the printer to the second printing unit 120 starting with the tail end thereof that is on the side opposite to that of the lead end at the time of the discharge, and the recording operations can be executed for both sides of the recording medium using the plural (for example, two) printers having an identical configuration.

The second printing unit 120 can thereby execute the recording operation for the other side of the recording medium for which the recording operation has already been executed for one side by the first printing unit 110, in parallel to the recording operation for the one side of the recording medium executed by the first printing unit 110.

Reduction of the time period until the completion of the two-side recording for plural recording mediums can be facilitated compared to a case where one printer executes a recording operation for each of the sides of plural recording mediums of the same number as above.

Design and development for a dedicated printer capable of executing the recording operations for both sides of the recording medium are unnecessary by executing the recording operations for both sides of the recording medium using the first printing unit 110 and the second printing unit 120 having an identical configuration, and the parts can be commonalized between the mechanism executing the recording operation for one side of the recording medium and the mechanism executing the recording operation for the other side. The cost for design and development and the cost for manufacture of the system to execute the recording operations for both sides of the recording medium can thereby be suppressed.

The recording medium discharged from the first printing unit 110 is supplied by the second printing unit 120 to the position to which the second printing unit 120 pulls the recording medium from the second holding unit 202, along the direction identical to the direction to pull out the recording medium, and the recording operations can thereby be executed according to identical control for the recording medium held by the second holding unit 202 and for the recording medium supplied from the first printing unit 110 to the second printing unit 120.

Design and development for a dedicated printer capable of executing the recording operations for both sides of the recording medium are thereby unnecessary, and the parts can be commonalized between the mechanism executing the recording operation for the one side of the recording medium and the mechanism executing the recording operation for the other side. The cost for design and development and the cost for manufacture of the system to execute the recording operations for both sides of the recording medium can thereby be suppressed.

As described above, according to the first feeding unit 130 and the second feeding unit 140 of the first embodiment of the present invention, improvement of the throughput related to the two-side recording can be facilitated without any cost for the development, the design, and the manufacture.

The first feeding unit 130 and the second feeding unit 140 of the first embodiment according to the present invention are provided near the first discharging exit 205 to be the position for discharging the recording medium from the first printing unit 110, and are characterized in that the recording medium is sorted by the flap-like member 226 that arbitrarily switches between the first position to communicate the first discharging exit 205 and the guide path 229 with each other and the second position to communicate the pair of feeding rollers 225 and the guide path 229 with each other.

According to the first feeding unit 130 and the second feeding unit 140 of the first embodiment of the present invention, the recording medium discharged from the first printing unit 110 can be sorted using the simple configuration. Improvement of the throughput related to the two-side recording can thereby be facilitated without an increase of the load applied to the control and without any cost for the development, the design, and the manufacture even when a control unit is added to the first printing unit 110.

The first feeding unit 130 and the second feeding unit 140 of the first embodiment according to the present invention are characterized in that the pair of feeding rollers 225 is provided at the position different from the side of the second feeding unit 140 in the first printing unit 110 and the tray 150 is included that includes the space accommodating the recording medium sorted to the position different from the side of the second feeding unit 140, without folding/bending the recording medium.

According to the first feeding unit 130 and the second feeding unit 140 of the first embodiment of the present invention, the space to accommodate the recording medium set to have a paper sheet shape by cutting the long strip-like recording medium may have a thin and flat shape. The surfaces of the recording medium discharged from the first printing unit 110 and fed with the side opposite to that of the second printing unit 120 can be inverted to each other without damaging the recording medium by only securing a thin and flat space of the size accommodating the recording medium without folding the recording medium.

The first feeding unit 130 and the second feeding unit 140 of the first embodiment according to the present invention are characterized in that the tray 150 including the space that accommodates the recording medium sorted to the position different from the side of the second feeding unit 140 without folding the recording medium is provided on the side opposite to the position at which the first printing unit 110 and the second printing unit 120 overlaps each other, relative to the first printing unit 110.

According to the first feeding unit 130 and the second feeding unit 140 of the first embodiment of the present invention, by providing the tray 150 on the second printing unit 120 side in the first printing unit 110, the recording operation can be executed by the printer 100 having an identical configuration in any case regardless of presence or absence of the tray 150, that is, regardless of whether the recording operation needing the inversion of the recording medium or the recording operation needing recording of a special color and special processing such as foil stamping.

The printer 100 can thereby be provided that has a high degree of freedom to be able to execute the recording operation according to the use by each user without any cost for the development, the design, and the manufacture thereof.

The first feeding unit 130 and the second feeding unit 140 of the first embodiment according to the present invention are characterized in that the recording medium is accommodated in the space by the rotation of the pair of feeding rollers 255 in the first rotation direction and the recording medium is fed to the guide path 229 starting with the tail end thereof by the rotation of the pair of feeding rollers 255 in the second rotation direction that is the reverse direction to the first rotation direction.

According to the first feeding unit 130 and the second feeding unit 140 of the first embodiment of the present invention, the recording medium discharged from the first printing unit 110 can be sorted by the simple configuration. Improvement of the throughput related to the two-side recording can thereby be facilitated without any increase of the load applied to the control and without any cost for the development, the design, and the manufacture even when a control unit is added to the first printing unit 110.

The first feeding unit 130 and the second feeding unit 140 of the first embodiment according to the present invention are characterized in that the flap-like member 226 sorts the recording medium discharged from the first printing unit 110 to the upper side or the lower side in the vertical direction and the recording medium fed to the pair of feeding rollers 225 is fed to the guide path 229 along the vertical direction.

According to the first feeding unit 130 and the second feeding unit 140 of the first embodiment of the present invention, because the recording medium for which the recording operation is executed is generally discharged from the front side of the printer or another printer, the first printing unit 110 and the second printing unit 120 can be stacked on each other along the vertical direction and the feeding units 130 and 140 can be provided in the front of the first printing unit 110 and the second printing unit 120 by executing along the vertical direction the sorting of the recording medium discharged from the first printing unit 110 and the feeding of the recording medium from the pair of feeding rollers 225 to the guide path 229.

Increases in the size of the printer 100 including the first printing unit 110 and the second printing unit 120 stacked on each other along the vertical direction (the printing system) can be suppressed and improvement of the throughput related to the two-side recording can be facilitated without any cost for the development, the design, and the manufacture thereof.

According to the first feeding unit 130 and the second feeding unit 140 of the first embodiment of the present invention, when the recording medium causes jamming in the feeding unit 130 or 140 due to, for example, the inversion of the sides to each other, the work for resolving the jamming can be executed easily and reliably, by providing the feeding units 130 and 140 in the front of the first printing unit 110 and the second printing unit 120.

The first feeding unit 130 and the second feeding unit 140 of the first embodiment according to the present invention respectively include the housings 130*a* and 140*a* accommodating the pair of feeding rollers 225, the guide path 229, and the feeding part, and are characterized in that the housings 130*a* and 140*a* include the discharging unit (the discharging exit 141) that discharges the recording medium discharged from the second printing unit 120 to the exterior of the housings.

According to the first feeding unit 130 and the second feeding unit 140 of the first embodiment of the present invention, the recording medium discharged from the second printing unit 120 can be fed to the exterior of the housing without damaging the recording medium even when the feeding units 130 and 140 are provided in the front of the first printing unit 110 and the second printing unit 120 stacked on each other along the vertical direction.

Second Embodiment

A printer of the second embodiment according to the present invention will be described below. In the second embodiment, the same components as those of the first embodiment are given the same reference numerals used in the first embodiment and will not again be described.

(Internal Configuration of Printer)

Figure 15:
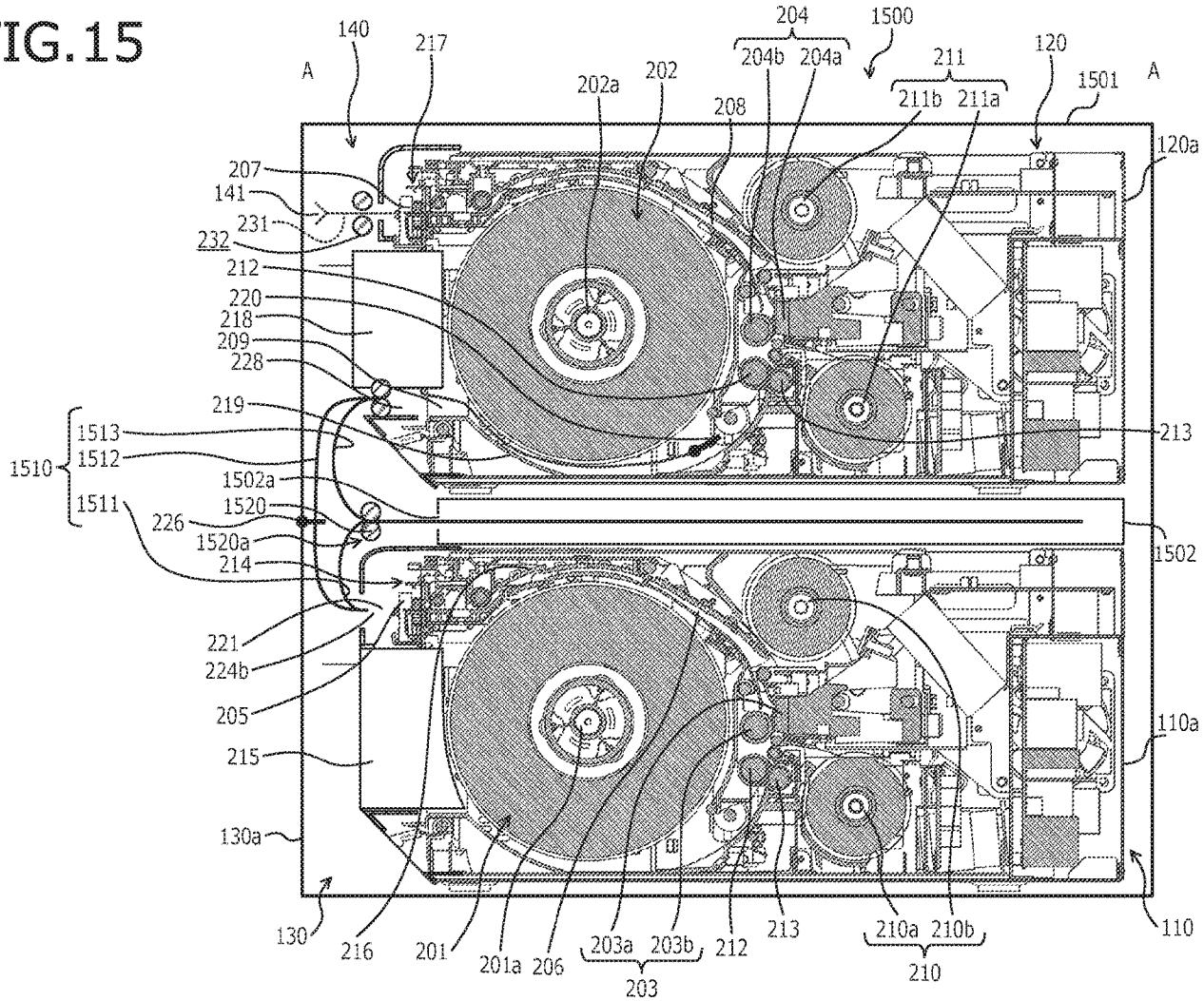
FIG. 15 is an explanatory diagram of an internal configuration of a printer of a second embodiment according to the present invention.

FIG. 15 is an explanatory diagram of an internal configuration of a printer of a second embodiment according to the present invention. In FIG. 15, the printer of the second embodiment according to the present invention includes a housing 1501 that accommodates the first printing unit 110 and the second printing unit 120. FIG. 15 depicts a cross-section of the printer 1500 at a position equivalent to the A-A line in FIG. 1. The printer 1500 includes a tray 1502 arranged between the first printing unit 110 and the second printing unit 120 stacked on each other along the vertical direction.

The printer 1500 is not limited to the one that has a tangible object such as the tray 1502 provided therein. In the printer 1500, a space sufficient to accommodate the recording medium therein without folding the recording medium may be secured between the first printing unit 110 and the second printing unit 120 without providing any member such as the tray 1502 therebetween. For example, the "space sufficient to accommodate the recording medium therein without folding the recording medium" can be secured between the first printing unit 110 and the second printing unit 120 by adjusting the positional relation between the first printing unit 110 and the second printing unit 120 in the housing 1501.

The tray 1502 includes an opening 1502*a* on the same side as that of the discharging exit 205, in the tray 1502. The opening 1502*a* is provided higher in the vertical direction than the position of the first discharging exit 205. In the housing 1501, an inverting path 1510 is provided that communicates the first discharging exit 205, the opening 1502*a*, and the insertion entrance 209 with each other.

The inverting path 1510 includes a path 1511 communicating the first discharging exit 205 and the opening 1502*a*, a path 1512 communicating the opening 1502*a* and the insertion entrance 209, and a path 1513 communicating the first discharging exit 205 and the insertion entrance 209. A path leading from the first discharging exit 205 to the insertion entrance 209 through the opening 1502*a* and the space in the tray 1502 (that is, the path 1511 and the path 1512) and a path directly leading from the first discharging exit 205 to the insertion entrance 209 (that is, the path 1513) are thereby formed in the housing 1501.

In the inverting path 1510, the flap-like member 226 realizing the sorting part is provided at the branching position for the path leading from the first discharging exit 205 to the insertion entrance 209 through the opening 1502*a* and the space in the tray 1502, and the path directly leading from the first discharging exit 205 to the insertion entrance 209. The position of the flap-like member 226 can be switched arbitrarily between a first position to communicate the first discharging exit 205 and the opening 1502*a* with each other and a second position to communicate the first discharging exit 205 and the insertion entrance 209 with each other, by swinging the flap-like member 226 with the fixed one end thereof as the fulcrum therefor.

When the flap-like member 226 is positioned at the second position, the flap-like member 226 sorts the recording medium discharged from the first printing unit 110 to the upper side in the vertical direction and, when the flap-like member 226 is positioned at the first position, the flap-like member 226 sorts this recording medium in the lateral direction, that is, to the space in the tray 150. The flap-like member 226 feeds the recording medium fed to the space in the tray 150, to the insertion entrance 229 along the vertical direction.

In the path 1513, a guide member (not depicted) guiding the position of the recording medium fed in the path 1513 is provided near the insertion entrance 209. The guide member can be realized by, for example, a member having a shape that is curved to direct the lead end of the recording medium fed from the first printing unit 110 or from the space in the tray 150 to the second printing unit 120 side, near the insertion entrance 209 in the path 1513. In the second embodiment, the guiding part according to the present invention can be realized by the guide member provided in the path 1513 or the path 1513.

In the inverting path 1510, a pair of feeding rollers 1520 is provided near the position for the branching of the path 1511 guiding the recording medium to the opening 1502*a* and the path 1511 guiding the recording medium discharged from the space in the tray 1502 through the opening 1502*a*, to the path 1512 through the insertion entrance 209, and at a position closer to the tray 1502 than the position for the branching. In the second embodiment, the feeding part according to the present invention can be realized by the pair of feeding rollers 1520.

One roller 1520*a* of the pair of rollers 1520*a* and 1520*b* included in the pair of feeding rollers 1520 is coupled with a driving source such as a motor to drive the one roller 1520*a*, a power transmission mechanism that transmits the driving force generated by the driving source to the one roller 1520*a*, and the like.

The motor to drive the one roller 1520*a* is rotatable in both of directions of a forward direction and a reverse direction. The one roller 1520*a* is thereby rotated in the direction according to the rotation direction of the motor. The one roller 1520*a* can thereby be rotated in both of the directions to feed the recording medium discharged from the first discharging exit 205 to the space in the tray 1502 (hereinafter, referred properly to as "first rotation direction") and to feed the recording medium from the space in the tray 1502 toward the exterior of the space (hereinafter, referred properly to as "second rotation direction").

In the second embodiment, the feeding unit according to the present invention can be realized by the switching member 220, the flap-like member 226, the tray 1502, the paths 1511, 1512, 1513, the pair of feeding rollers 1520, and the like. In the second embodiment, the housing 1501 of the printer 1500 realizes the housing of the feeding unit according to the present invention.

(Recording Operation Executed by Printer 1500)

The printer 1500 can execute the recording operation related to the one-side recording, the recording operation related to the two-side recording, and the recording operation to additionally record the special color. For the one-side recording, the printer 1500 executes the recording operation similarly as that of the printer 100.

(Two-Side Recording)

For the recording operation related to the two-side recording, the printer 1500 positions the flap-like member 226 at the first position in the first printing unit 110 and positions the switching member 220 at the position for a cut paper sheet in the second printing unit 120, based on a two-side recording instruction received from the external apparatus 300.

The recording operation for all the colors is executed for the one side of the recording medium and an overcoat layer is provided on the recorded face (the front side) of the recording medium for which the recording operation has been executed for the one side. The pair of feeding rollers provided in the first feeding path 206 is thereafter rotated in the direction whereby the recording medium on which the overcoat layer has been provided moves from the first holding unit 201 to the first discharging exit 205. In a state where the recording medium on which the overcoat layer has been provided is pulled to a predetermined position, both ends of the recorded portion of the recording medium for which the recording operation has been executed for one side (the front side) are thereafter cut off by the first cutter mechanism 214.

The cut paper sheet-like recording medium for which the recording operation has been executed for one side (the front side) is fed to the space in the tray 1502 through the first discharging exit 205 and the opening 1502*a*, that is, the path 1511. For example, in the printer 1500, because the flap-like member 226 is positioned at the first position, as to the recording medium fed from the first discharging exit 205 side to the opening 1502*a* side, when the lead end thereof abuts the flap-like member 226, the recording medium bends toward the opening 1502*a* along the flap-like member 226. In this state, the pair of feeding rollers provided in the first feeding path 206 is further rotated and the cut paper sheet-like recording medium for which the recording operation has been executed for one side (the front side) can thereby be fed to the space in the tray 1502 starting with the lead end of the recording medium.

The printer 1500 rotates, in the forward direction, the one roller 1520*a* included in the pair of feeding rollers 1520 until the tail end of the recording medium cut off by the first cutter mechanism 214 passes through the position of the lead end of the flap-like member 226 that is positioned at the first position. The recording medium fed by the rotation of the one roller 1520*a* in the forward direction is fed to the space in the tray 1502 through the opening 1502*a* starting with the lead end thereof.

The printer 1500 thereafter positions the flap-like member 226 at the second position and rotates the one roller 1520*a* in the reverse direction. The cut paper sheet-like recording medium for which the recording operation has been executed for one side (the front side) and that is fed to the space in the tray 1502 starting with the lead end thereof is thereby fed from the space in the tray 1502 to the exterior through the opening 1502*a* and is fed toward the insertion entrance 209.

At this time, because the flap-like member 226 is positioned at the second position, the recording medium fed from the space in the tray 1502 to the exterior is bent toward the insertion entrance 209 along the flap-like member 226 when the lead end thereof abuts the flap-like member 226. In this state, the printer 1500 further rotates the one roller 1520*a* included in the pair of feeding rollers 1520 and the cut paper sheet-like recording medium for which the recording operation has been executed for one side (the front side) can thereby be fed to the second printing unit 120 through the insertion entrance 209 starting with the tail end of the recording medium.

The side facing the first thermal head 203*a* and the side facing the second thermal head 204*a* of the recording medium can be inverted to each other by feeding the recording medium fed to the space in the tray 1502 starting with the lead end thereof, and to the second printing unit 120 starting with the tail end thereof.

When the second printing unit 120 detects the recording medium inserted from the insertion entrance 209, similarly to that of the printer 100, the second printing unit 120 rotates the pair of feeding rollers in the forward direction to execute a same recording operation as the recording operation for the above one-side recording based on the back side recording instruction that is received from the external apparatus 300. Because the side facing the first thermal head 203*a* and the side facing the second thermal head 204*a* of the recording medium are inverted to each other, recording can be executed for both sides of the recording medium by executing the same recording operation as the one-side recording by the second printing unit 120.

In the two-side recording, in the recording operation by the first printing unit 110, when the recording medium that is to be recorded on is cut off with the margin at the lead end of the recording medium remaining therewith as described above, the second printing unit 120 cuts off the margin at the lead end of the recording medium using the second cutter mechanism 217 in the recording operation related to the two-side recording.

In the recording operation by the second printing unit 120 related to the two-side recording, the margin on the tail end of the recording medium that is to be recorded on is cut off and the recording medium is discharged from the discharging exit 141 to the exterior of the printer. In this manner, the two-side recording can be executed for the recording medium.

(Recording Operation to Add Special Color)

When the printer 1500 executes the recording operation to additionally record the special color on the recording side of the recording medium for which the one-side recording is executed, the first feeding unit 130 positions the flap-like member 226 at the second position by the time when the recording operation by the first printing unit 110 is completed. The recording medium for which the one-side recording has been executed by the first printing unit 110 is bent toward the insertion entrance 209 along the flap-like member 226 when the lead end thereof abuts the flap-like member 226.

In this state, the printer 1500 rotates the one roller 1520*a* included in the pair of feeding rollers 1520 and the cut paper sheet-like recording medium for which the recording operation has been executed for one side (the front side) is thereby fed to the second printing unit 120 through the insertion entrance 209 starting with the tail end side of the recording medium. In this manner, the recording medium fed to the feeding path 1511 starting with the lead end thereof is fed to the second printing unit 120 starting with the lead end thereof, and the side facing the first thermal head 203*a* and the side facing the second thermal head 204*a* of the recording medium can thereby be kept to be the same side.

The recording medium can be fed to the second printing unit 120 in a state where the same side as the recording side facing the recording position of the first recording unit 203 is caused to face the recording position of the second recording unit 204. The recording operation can thereby be executed to additionally record the special color on the recording side of the cut paper sheet-like recording medium for which the recording operation has been executed for one side (the front side), by executing the same recording operation as that for the one-side recording by the second printing unit 120.

As described above, the printer 1500 of the second embodiment including the feeding unit according to the present invention is characterized in that the space in the tray 1502 is provided between the first printing unit 110 and the second printing unit 120.

According to the printer 1500 of the second embodiment of the present invention, the recording medium for which the recording operation is executed by the first printing unit 110 can be caused to pass through the paths 1512 and 1513 and can thereby be inverted to thereafter be fed to the second printing unit 120. When the recording medium is not inverted, the recording medium can directly be fed to the second printing unit 120 by causing the recording medium to pass through the path 1511. The printer 1500 can thereby accommodate the path to invert the sides of the recording medium to each other, between the first printing unit 110 and the second printing unit 120.

According to the printer 1500, increases in the size of the printer 1500 (the printing system) can thereby be suppressed and improvement of the throughput related to the two-side recording can be facilitated without any cost for the development, the design, and the manufacture thereof, compared to the printer 100 having a configuration to secure a mechanism related to the inversion such as the inverting path (see the inverting path 224 in the printer 100 of the first embodiment) in the front of the first printing unit 110 and the second printing unit 120. An effect of facilitating improvement of the aesthetic appearance of the printer 1500 can be expected compared to the case where the mechanism related to the inversion is proved in the front of the printer 1500.

According to the printer 1500 of the second embodiment of the present invention, the configuration is employed to accommodate the path to invert the sides of the recording medium to each other and the tray 1502, between the first printing unit 110 and the second printing unit 120, and the pair of feeding rollers 1520 can thereby be arranged at the position closer to the second printing unit 120 compared to the pair of feeding rollers 225 in the printer 100 of the first embodiment.

The distance from the first printing unit 110 to the second printing unit 120 can thereby be reduced and, compared to a case where the path to invert the sides of the recording medium to each other and the tray 1502 are not accommodated between the first printing unit 110 and the second printing unit 120, the number of rollers necessary for feeding the recording medium for which the recording operation is executed by the first printing unit 110 to the second printing unit 120 can be reduced. Improvement of the throughput related to the two-side recording can thereby be facilitated without any cost for the development, the design, and the manufacture.

According to the printer 1500 of the second embodiment of the present invention, a configuration is employed to accommodate the path to invert the sides of the recording medium to each other and the tray 1502, between the first printing unit 110 and the second printing unit 120, and the first printing unit 110 and the second printing unit 120 can each thereby be independently configured. Setting the first printing unit 110 and the second printing unit 120 to each be able to independently be configured enables easy commonalization for the first printing unit 110 and the second printing unit 120.

For example, as described above, the printer 1500 can be realized by handling the first printing unit 110 and the second printing unit 120 each as an independent part and stacking these printing units 110 and 120 on each other in the vertical direction. According to the printer 1500, improvement of the throughput related to the two-side recording can be facilitated without any cost for the development, the design, and the manufacture thereof.

According to the printer 1500 of the second embodiment of the present invention, even when the printer 1500 is used in a state having no mechanism (for example, the tray 1502, the path 1511, the path 1512, and the pair of feeding rollers 1520) related to the inversion provided therein, commonalization of the components in the printer 1500 in a state having the mechanism related to the inversion (that is, the state depicted in FIG. 15) can be executed easily. For example, the printer 1500 is usable in a state having no mechanism related to the inversion provided therein to have a configuration only removing the tray 1502, the path 1511, the path 1512, the pair of feeding rollers 1520, and the like therefrom. Increases in the size of the printer 1500 (the printing system) can thereby be suppressed and improvement of the throughput related to the two-side recording can be facilitated without any cost for the development, the design, and the manufacture thereof.

The printer 1500 of the second embodiment according to the present invention is characterized in that the flap-like member 226 realizing the sorting part sorts the recording medium discharged from the first printing unit 110 to the upper side in the vertical direction to thereby feed the recording medium to the second printing unit 120, and sorts the recording medium in the direction intersecting the vertical direction (for example, the lateral direction) to thereby feed the recording medium to the space in the tray 1502, and the recording medium fed to the space is fed to the insertion entrance 209 along the vertical direction.

According to the printer 1500 of the second embodiment of the present invention, when the tray 1502 (that is the space accommodating the recording medium) is provided between the first printing unit 110 and the second printing unit 120, the sorting of the recording medium discharged from the first printing unit 110 and the feeding of the recording medium from the pair of feeding rollers 1520 to the guide path 1510 can also be executed in the front of the printer 1500, and the inversion of the recording medium can be executed between the first printing unit 110 and the second printing unit 120. Increases in the size of the printer 1500 (the printing system) can thereby be suppressed and improvement of the throughput related to the two-side recording can be facilitated without any cost for the development, the design, and the manufacture thereof.

Increases in the size of the printer 1500 (the printing system) including the first printing unit 110 and the second printing unit 120 stacked on each other in the vertical direction can be suppressed and improvement of the throughput related to the two-side recording can be facilitated without any cost for the development, the design, and the manufacture thereof.

According to the printer 1500 of the second embodiment of the present invention, the feeding unit (the switching member 220, the flap-like member 226, the tray 1502, the paths 1511, 1512, and 1513, the pair of feeding rollers 1520, and the like) is provided in the front of the first printing unit 110 and the second printing unit 120 and, for example, when the recording medium becomes jammed in the feeding unit 130 or 140 for inverting the sides of the recording medium, the work for resolving the jamming can thereby easily and reliably be executed.

The application example in which the printer 100 is configured by attaching the independent feeding units 130 and 140 respectively to the printing units 110 and 120 each capable of independently executing a recording operation has been described in the first embodiment, however, the configuration is not limited hereto. The printer according to the present invention may be realized by a printer that is integrally configured by accommodating the configurations and the functions of the printing units 110 and 120, and the configurations and the functions of the feeding units 130 and 140 in a single housing.

This printer includes, for example, a printing unit including a holding unit that holds a long strip-like recording medium in a wound state, a recording unit that executes a recording operation for the recording medium pulled out from the holding unit, and a cutter unit that cuts off the long strip-like recording medium for which the recording operation is executed by the recording unit, a sorting part that sorts the recording medium cut off by the cutter unit to the side of another printing unit having the same configuration as that of the printing unit and stacked on the printing unit, or to the side opposite to that of the other printing unit, a guiding part that guides the recording medium sorted by the sorting part to the side of the other printing unit, for the recording medium to be supplied to a position to which another recording medium held by the other printing unit is pulled along the identical direction to the pulling-out direction of the other recording medium, and a feeding unit that accommodates the recording medium sorted by the sorting part to the side opposite to that of the other printing unit until the tail end of the recording medium passes through the sorting part, the feeding unit feeding the recording medium to the guiding part starting with the tail end thereof when the tail end passes through the sorting part. This printer is characterized in that the sorting part sorts the recording medium fed by the feeding unit, to the side of the other printing unit.

According to this printer, similarly to the first embodiment, a printer having a high degree of freedom and capable of executing a recording operation in accordance with the use of each user without a high cost for the development, the design, and the manufacture thereof can be provided.

INDUSTRIAL APPLICABILITY

As described above, the feeding unit and the printer according to the present invention are useful for a printer capable of recording on both sides of a recording medium and a feeding unit used in this printer and are especially suitable for a printer of which recording on one side and recording on both sides of a recording medium are required, and a feeding unit used in this printer.

EXPLANATIONS OF LETTERS OR NUMERALS

100 printer
110 first printing unit
120 second printing unit
130 first feeding unit
140 second feeding unit
150 tray
201 first holding unit
202 second holding unit
203 first recording unit
203*a* thermal head
203*b* platen
204 second recording unit
204*a* thermal head
204*b* platen
214 first cutter mechanism
217 second cutter mechanism
220 switching member
221 first opening
222 second opening
223 third opening
225 pair of feeding rollers
226 sorting part (flap-like member)
227 fourth opening
228 fifth opening
229 guide path
230 guide member
1500 printer
1501 housing
1502 tray
1502*a* opening
1511, 1512, 1513 path
1520 pair of feeding rollers
1520*a* one roller

The invention claimed is:

1. A feeding unit provided to a set of first printer and a second printer, each of the first and second printers including a holding unit that holds a long strip-like recording medium in a wound state and a recording unit that executes a recording operation with respect to the recording medium pulled out from the holding unit, the first printer and the second printer cutting off and discharging the long strip-like recording medium on which the recording operation has been executed, the feeding unit comprising:

a sorting part that sorts the recording medium discharged from the first printer, to a side of the second printer stacked on the printer and having a configuration identical to a configuration of the first printer, or to a position different from the side of the second printer;

a guiding part that guides the recording medium sorted by the sorting part to the side of the second printer, to be supplied to a position to which a second recording medium held by the holding unit of the second printer is pulled out, the guiding part guiding the recording medium along a direction identical to a direction to pull out the second recording medium; and a feeding part that accommodates the recording medium sorted to the position different from the side of the second printer by the sorting part, the feeding part accommodating the recording medium until a tail end of the recording medium passes through the sorting part, the feeding part feeding the recording medium to the guiding part starting with the tail end, when the tail end passes through the sorting part, wherein the sorting part sorts the recording medium fed by the feeding part, to the side of the second printer.

2. The feeding unit according to claim 1, wherein the sorting part is a flap-like member provided near a discharge position where the recording medium is discharged from the printer, the sorting part is arbitrarily switched between a first position to communicate the discharge position and the guiding part with each other and a second position to communicate the feeding part and the guiding part with each other.

3. The feeding unit according to claim 1, wherein the feeding part includes a space that is provided at a position different from the side of the second printer in the printer and that accommodates the recording medium sorted to the position different from the side of the second printer, without folding the recording medium.

4. The feeding unit according to claim 3, wherein the feeding part includes a pair of rollers that feed the recording medium sorted to the position different from the side of the second printer, to an inside of the space, the feeding part accommodates the recording medium in the space by rotating the pair of rollers in a first rotation direction, and feeds the recording medium to the guiding part starting with the tail end of the recording medium by rotating the pair of rollers in a second rotation direction that is reverse to the first rotation direction.

5. The feeding unit according to claim 3, wherein the space is provided on a side of the printer, opposite a side of the printer having a position at which the printer and the second printer are stacked on each other.

6. The feeding unit according to claim 5, wherein the sorting part sorts the recording medium discharged from the printer, to an upper side or a lower side in a vertical direction and feeds the recording medium fed to the feeding part, to the guiding part along the vertical direction.

7. The feeding unit according to claim 3, wherein the space is provided between the printer and the second printer.

8. The feeding unit according to claim 7, wherein the sorting part feeds the recording medium discharged from the printer, by sorting the recording medium to the upper side in the vertical direction, feeds the recording medium to the space by sorting the recording medium in a direction intersecting the vertical direction, and further feeds the recording medium fed to the space to the guiding part along the vertical direction.

9. The feeding unit according to claim 5, further comprising a housing that accommodates the sorting part, the guiding part, and the feeding part, wherein the housing includes a discharging unit that discharges to an exterior of the housing, the recording medium discharged from the second printer.

10. The feeding unit according to claim 7, further comprising a housing that accommodates the sorting part, the guiding part, and the feeding part, wherein the housing includes a discharging unit that discharges to an exterior of the housing, the recording medium discharged from the second printer.

11. A printer comprising:

a set of a first printing unit and a second printing unit, each of the first and the second printing units including:

a holding unit that holds a long strip-like recording medium in a wound state;

a recording unit that executes a recording operation for the recording medium pulled out from the holding unit; and a cutter unit that cuts the long strip-like recording medium for which a recording operation is executed by the recording unit;

a sorting part that sorts the recording medium cut off by the cutter unit of the first printing unit, to a side of the second printing unit stacked on the printing unit and having an identical configuration as that of the first printing unit, or to a position different from the side of the second printing unit;

a guiding part that guides the recording medium sorted by the sorting part to the side of the second printing unit, to be supplied to a position to which a second recording medium held by the holding unit of the second printing unit is pulled out, the guiding part guiding the recording medium along a direction identical to a direction to pull out the second recording medium; and a feeding part that accommodates the recording medium sorted to the position different from the side of the second printing unit by the sorting part, the feeding part accommodating the recording medium until a tail end of the recording medium passes through the sorting part, the feeding part feeding the recording medium to the guiding part starting with the tail end, when the tail end passes through the sorting part, wherein the sorting part sorts the recording medium fed by the feeding part, to the side of the second printing unit.

* * * * *